US008342901B1

(12) United States Patent
Deluz

(10) Patent No.: US 8,342,901 B1
(45) Date of Patent: Jan. 1, 2013

(54) INTERACTIVE SYNTHESIZER HOOP INSTRUMENT

(76) Inventor: Patrick Deluz, Encinitas, CA (US)

( * ) Notice: Subject to any disclaimer, the term of this patent is extended or adjusted under 35 U.S.C. 154(b) by 1041 days.

(21) Appl. No.: 11/343,416

(22) Filed: Jan. 31, 2006

Related U.S. Application Data

(60) Provisional application No. 60/648,907, filed on Feb. 1, 2005.

(51) Int. Cl.
*A63H 30/00* (2006.01)

(52) U.S. Cl. ..... 446/175; 446/184; 446/236

(58) Field of Classification Search ..... 446/175
See application file for complete search history.

(56) References Cited

U.S. PATENT DOCUMENTS

| | | | | | |
|---|---|---|---|---|---|
| 3,935,669 | A | * | 2/1976 | Potrzuski et al. | 446/485 |
| 4,006,556 | A | * | 2/1977 | Williams | 446/242 |
| 4,043,076 | A | | 8/1977 | Potrzuski | |
| 4,776,253 | A | * | 10/1988 | Downes | 84/645 |
| 4,915,666 | A | * | 4/1990 | Maleyko | 446/242 |
| 5,108,340 | A | * | 4/1992 | Farrow | 446/242 |
| 5,145,443 | A | * | 9/1992 | Vaisnys et al. | 446/242 |
| 5,338,244 | A | * | 8/1994 | Huang | 446/242 |
| 5,646,593 | A | * | 7/1997 | Hughes et al. | 340/573.1 |
| 6,036,573 | A | * | 3/2000 | Huang | 446/242 |
| 6,150,774 | A | | 11/2000 | Mueller | |
| 6,165,040 | A | * | 12/2000 | Burich | 446/242 |
| 6,265,984 | B1 | | 7/2001 | Molinaroli | |
| 6,491,516 | B1 | * | 12/2002 | Tal et al. | 431/253 |
| 6,497,603 | B1 | * | 12/2002 | Magers et al. | 446/242 |
| 2005/0255787 | A1 | * | 11/2005 | Pak | 446/236 |
| 2005/0260552 | A1 | | 11/2005 | Anderson | |

FOREIGN PATENT DOCUMENTS

| | | | |
|---|---|---|---|
| KR | 2002053783 | A * | 7/2002 |

* cited by examiner

*Primary Examiner* — Tramar Harper

(57) ABSTRACT

A lighted translucent hoop instrument is disclosed. This ruggedly constructed rechargeable hoop comes in a wide range of sizes, designed for a greater scope of movement and function than the "hula-hoop". It collapses for travel and can be assembled in seconds.

Mechanical switches and/or electronic sensors, accelerometers, circuits and programs make the hoop motion-sensitive, and control onboard lights to generate varying and repeatable colors, shapes, patterns and trails, based on the performance of the user. The signals generated by the onboard sensors can also be sent by radio to a computer. These signals modulate existing music, and also synthesize distinct sounds, combinations of sounds and visual displays.

The hoop thus becomes an interactive instrument/controller played by the whole body, creating coherent signals synchronized with motion. It is a tool for exercise, entertainment, communication, expression, juggling, dance, performance and play—by both children and adults.

3 Claims, 30 Drawing Sheets

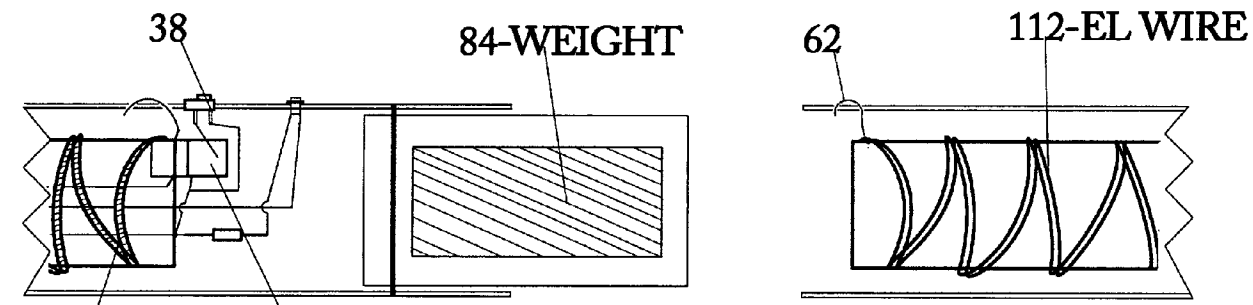
FIG.15A
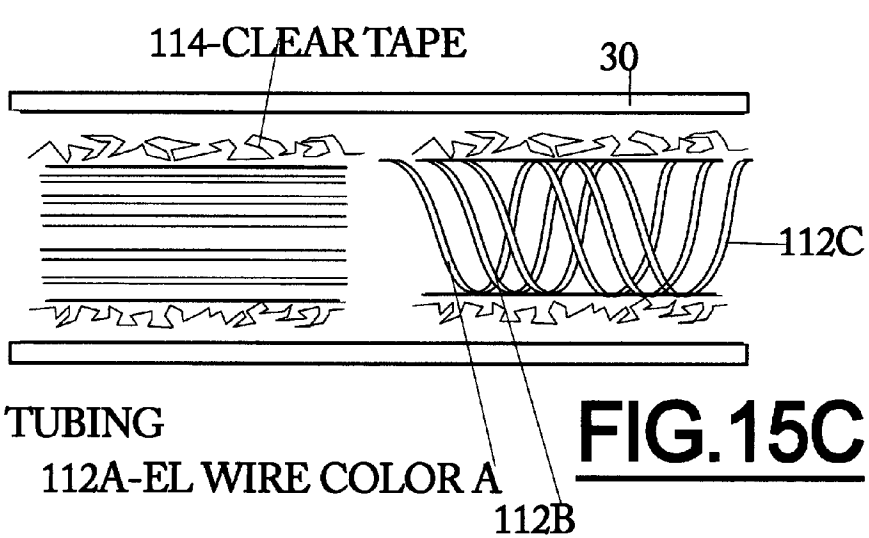
FIG.15C
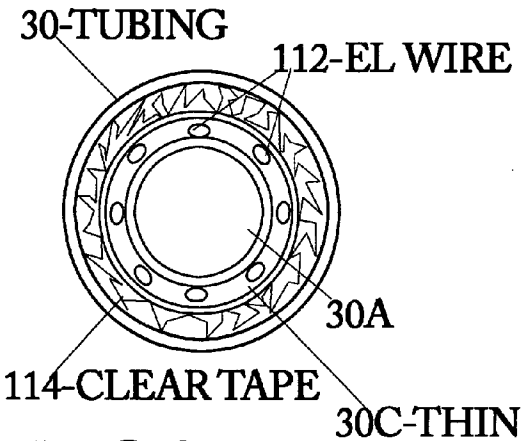
FIG15.B

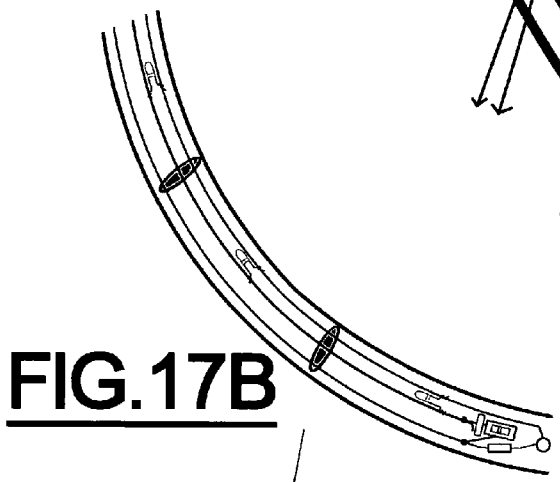
FIG.17B
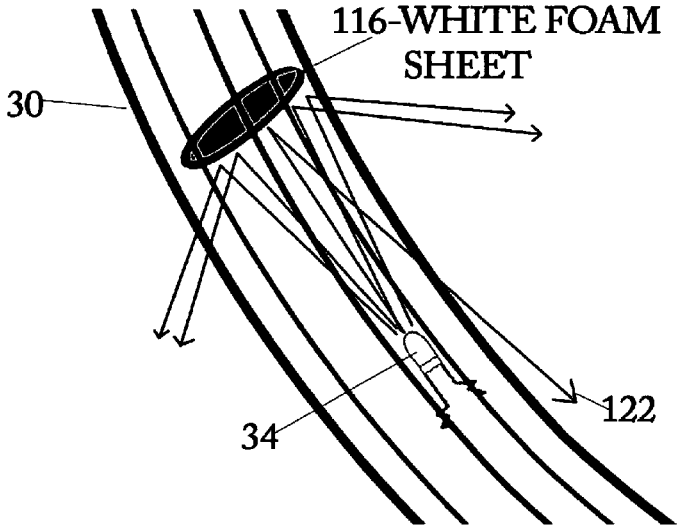
FIG.17D
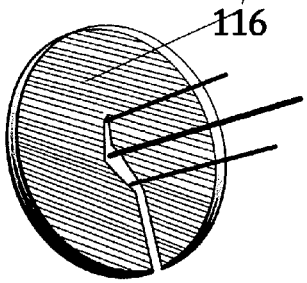
FIG.17C
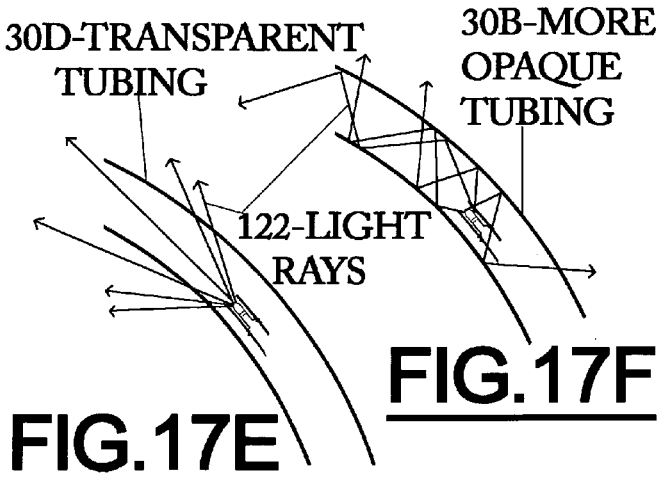
FIG.17E
FIG.17F

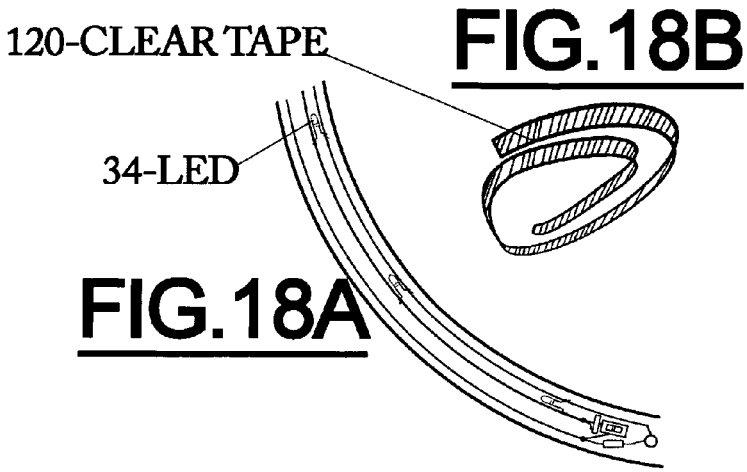
FIG.18B
FIG.18A
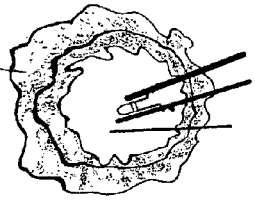
FIG.18C
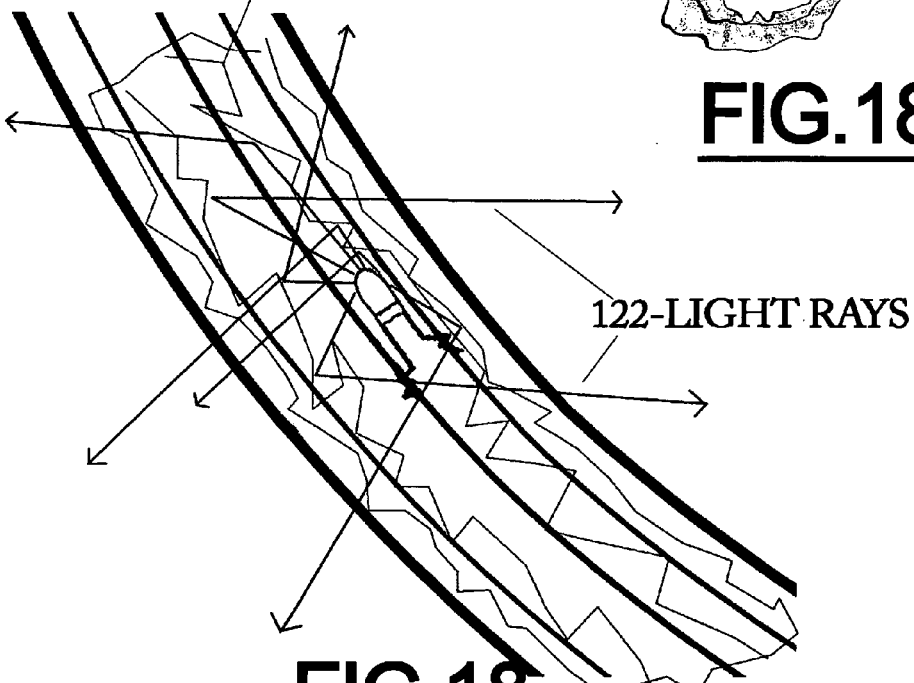
FIG.18

130-TRAILS

132-PATHWAY OF HOOP

29-HOOP

29-HOOP

136

134-USER

136-SHAPES
OF TRAILS

INTERACTIVE SYNTHESIZER HOOP INSTRUMENT

CROSS-REFERENCE TO RELATED APPLICATIONS

This application claims the benefit of PPA Appl. No. 60/648,907, filed Feb. 1, 2005, by the present inventor.

FEDERALLY SPONSORED RESEARCH

None

BACKGROUND OF THE INVENTION

This invention relates to hoops, particularly "hula-hoops", and to electronic instruments, light synthesizers, computer based synthesizers, and LED displays.

Prior Art

Hoops have been around for a very long time. Electronic instruments appeared in the last century. The combination of hoop and electronic instrument has never yet been successfully realized, as evidenced by the lack of their development, use or availability.

The Oxford dictionary gives the main definition of "hoop", to be "A circular band or ring of metal, wood or other stiff material." Also, definition 3 "A circle of wood or iron (orig. a barrel-hoop), which is trundled along as a plaything by children." The dictionary goes on to give examples from the 1700's and 1800's of twirling and trundling hoops. There was no mention of the word "hula" as yet associated with the hoop, but according to my web research, "The word hula became associated with the toy in the early 1800s when British sailors visited the Hawaiian Islands and noted the similarity between "hooping" and hula dancing". Although the "hula-hoop" was tremendously popular in the fifties, the name does impose some limitations on its use and contributes to its current lack of popularity. To "hula" is to dance the Hawaiian dance or imitate it in some way with a side-to-side motion of the hips. This form of movement is only a fraction of the potential of a hoop. Most people think only of a hoop being rotated around the waist when a "hula-hoop" is mentioned. To many adults, this is not an inspiring activity.

The hoop has been promoted and designed as a toy or piece of exercise equipment. This somewhat limits the use of the hoop to playgrounds or gyms. The hoop has nowhere in recent times been designed primarily as an instrument. Here is a quote from Anderson, Apr. 27, 2004 Ser. No: 10/832,508 "Hoop toys that are rolled or spun about the body, waist, neck, or arms are well known in the art. U.S. Pat. No. 3,079,728 represents the archetype of a hoop toy that may be spun about the body. Variations of this archetype have emerged since, such as: musical hoop toys, lighted hoop toys, segmented hoop toys, decorative cloth covered hoop toys, water filled hoop toys, and water emitting hoop toys." The emphasis is on toy. The size of earlier hula-hoops is basically too small for the majority of adults to learn on and use freely. Perhaps the size was kept small so that the hoops could be transported more easily, perhaps to limit production costs, perhaps because that size seemed to work for the target audience, which was children. An adult needs a certain weight and size for a hoop to perform many of its movements with ease. This was not provided for in the prior art. I have seen sizes up to just over three feet in diameter, but this is nowhere near big enough for most adults, especially if they are beginners or large of body.

Previous lighted hula hoops relied on electric bulbs or single colored low output LEDs. For example, Williams, U.S. Pat. No. 4,006,556, discloses placing a series of light bulbs inside the hoop. See also, Chao, U.S. Pat. No. 3,911,264. According to Vaisnys et al., U.S. Pat. No. 5,145,443 Sep. 8, 1992 "Although the idea of adding lights to a hula hoop theoretically could increase interest in this type of toy, it is significant to note that the user can only somewhat see the lights in use. Typically, the user keeps his or her eyes facing forward when playing with a hula hoop. In this position, the lights proposed by Williams can only be seen at the periphery of the user's vision. As a result, to the present inventors' knowledge, the lighted hula hoop has not been commercially accepted." (My underlining.) The lights they were talking about were obviously very dim. The imagined movements of the hoop seem to be limited to the hula dance movements. Vaisnys goes on to propose a musical hoop and describe placing speakers inside the hoop. The problem with this is that the movements of the hoop distort the sounds, and the quality of the tiny speakers you would need in order not to overweight the hoop and not to draw too much power, would render the sounds and music of low quality.

Although the quality of light and sound described in the prior art may have been suitable for some purposes, it was not enough to fuel much interest in that kind of application for the hoop. In my searches I have not been able to find anyone building, manufacturing or using these kinds of hoops. The colors and trails that they produce and the quality and variety of sounds have not seemed to inspire people in their use.

My patent pending filed Feb. 1, 2005 60/648,907 describes a flashing lighted interactive hoop. Since that time, through the feedback of many professional hoop performers and other users, the invention has evolved in the direction stated in the patent pending. The flashing lighted displays have become more refined, brighter, more varied and interesting. The hoop has become more interactive, with the refinement of the control systems, the taping of the hoop, the inclusion of audio interpretation of the signals and so forth.

The construction of the hoops in much of the prior art gives attention to the ease of assembly, but not to the integrity of the hoop in its assembled form. I find little attempt to reduce the noise of the internal components while the hoop is in use. I know that I had to find ways to reduce the rattle and movement of the wires, batteries, lights, boards, switches, and other internal components. There is no discussion of increasing the visual display by appropriate taping, voltage adjustment, mixing colors, having different colors on different circuits, using LEDs with multiple colors and so forth. The sound generation systems seem to be limited to onboard speakers or low quality outputs. There is little development of the idea of interactivity or responsiveness on the part of the hoop. I cant find where the prior art has attempted to give coherence to the visual and auditory outputs or to create a synergy between them. The placement of the batteries is important to the spinning of the hoop, particularly when it is thrown in the air, as is done by rhythmic gymnasts and hoop performers. If the hoop is imbalanced it wobbles and this reduces its use as both an instrument (because it is then giving "noise" rather than response, rather like a screeching microphone when you get too close to it).

Potrzuski, et al., U.S. Pat. No. 4,043,076 Aug. 23, 1977 discloses an electrical signal mechanism actuated in response to rotation about any of three axes. This did not apply directly to a hula-hoop, but I include it here as an example of prior art in the field of electronic displays. Moliinaroli U.S. Pat. No. 6,265,984 Jul. 24, 2001, discloses a light emitting diode display device, which is a pre-programmed device and method for forming and displaying images. Mueller, et al. U.S. Pat. No. 6,150,774 Nov. 21, 2000 discloses a multicolored LED lighting method and apparatus. In fact Color Kinetics have a number of patents on microprocessor controlled LEDs. None of these specifically relate to hoops, and certainly not to hoops as instruments. They do show advances in the technology for controlling LEDs and color in general.

I don't think that anyone has really looked at the pathway that each point on a hoop follows. The closest reference I find is from Maleyko, U.S. Pat. No. 4,915,666 Apr. 10, 1990. A lighted hoop. I quote "The tube 12 is translucent and contains a multiplicity of light sources 20 spaced circumferentially around the tube which will cause the tube to glow with a desired degree of brightness. The term "translucent", as used herein, means that the wall of the tube transmits the light with a degree ranging from transparency to opacity. Preferably, the tube has a translucency which diffuses the light around the tube. When the lighted hoop is manipulated as depicted in FIG. 1, the brightness of the hoop and the persistence of vision give the illusion of a multiplicity of light rings emanating in orbital paths from a gyrating focal point." This begins to describe some of the effects that proper lighting can achieve in a hoop, but it is a small piece indeed.

Maleyko mentions "a multiplicity of light rings emanating in orbital paths from a gyrating focal point." To my knowledge, no one has analyzed this further. They have thus not explored the patterns of lights, colors and trails that a hoop can generate. There is also no mention of the mixing of colors possible by including many lights sources close together. Also no mention of the effects of taping the hoop is various ways, or of having LEDs that flash and can be programmed or affected by the motions of the user. Maleyko does talk about different colored LEDs. Even if there was more than one color of LED in the hoop, the colors were spaced apart and could not interact or mix colors.

Vaisnys et al., Sep. 8, 1992. He does talk about the variations in speed of the point on a hoop:

"Sound generation which varies with the rate of rotation of the hoop is obtained as follows. During each rotation, plug 13 passes through a zone of minimum acceleration in the region of the user's body and a zone of maximum acceleration at the extreme position from the user's body. Switch 20 is selected so that it is closed in the zone of maximum acceleration and is open in the zone of minimum acceleration. The output of this switch is used to generate an input for the sound adjusting pin of the sound generation chip. For example, the closing of the switch can be used to charge or discharge a capacitor, and the voltage across the capacitor can be applied to the sound adjusting pin. Alternatively, a digital counter, either internal to the sound generation chip or as a separate chip, can be used to produce a signal which varies monotonically with the rate of opening or closing of switch 20."

There is an acknowledgement there that there is a zone of minimum and maximum acceleration, and the use of that as an on/off switch, but that is as far as it goes.

U.S. Pat. No. 5,108,340 to Farrow discloses a hula hoop having a sound system that generates music and a lighting system. The Farrow patent discloses that the lighting system may include a plurality of light bulbs and a plurality of pressure switches that are positioned in an interior portion of the hula hoop so to make contact with the person using the hula hoop.

U.S. Pat. No. 5,145,443 to Vaisnys, et al. discloses that the hoop may receive FM broadcasts . . . . It should be appreciated that the controller 80 may be a single-chip microcontroller, which may or may not include the audio generator 88. The audio generator 88 may be any type of integrated circuit or device capable of generating music sequences. For example, the audio generator 88 may be provided in the form of an AM or FM receiver that receives broadcast music."

There is no mention of the hoop itself being the instrument, broadcasting the signal to a receiver.

The problem with all these inventions, as far as a hoop synthesizer is concerned is that to the best of my knowledge they don't work as instruments . . . . They are described as toys, or exercise equipment, and so they are. Toys are great and the world is made better by their development, but the hoop does not have to be just a toy.

Objects and Advantages

The synthesizer hoop generates a great deal of light. In a dark room you can read by it! In the last several months I have attended events where hundreds of people, and on one occasion more than a thousand people were all able to see the hoop at one time. This is in contrast to the statement above where Vaisnys et al., U.S. Pat. No. 5,145,443 Sep. 8, 1992 says "Although the idea of adding lights to a hula hoop theoretically could increase interest in this type of toy, it is significant to note that the user can only somewhat see the lights in use. Typically, the user keeps his or her eyes facing forward when playing with a hula hoop. In this position, the lights proposed by Williams can only be seen at the periphery of the user's vision". Looking at the illustrations of FIGS. 27A-H and 27J it will be apparent that for much of the time the lights will definitely not be at the periphery of the user's vision. They are everywhere, or that is how it appears to someone using this hoop. The sound, as it is routed through an amp and speakers of whatever power desired, also has sufficient range and clarity to synchronize with the display of lights and movements of the body.

In order for the hoop to truly function as a light and sound instrument, it needs to respond in real time to all the movements the hoop is making. The sensitivity of the response needs to be adjustable, as does the program that interprets a given signal to produce a certain response. Some sensors now have the size, sensitivity and low cost necessary to make this viable. In order to extrapolate the position of all the lights sources at any given time, the pathway of the hoop needs to be understood in three dimensions.

The spiral path of any one point in a hoop is determined by the girth of the axis the hoop is spinning around. The greater the difference in relative size between the diameter of the hoop and the diameter of the axis, the more revolutions it takes for the hoop to complete its spiral path. See FIGS. 20A-D. In practice this means that the smaller the diameter of the axis, the easier it is to keep the hoop spinning . . . with a small hoop it is much easier to spin it around your finger, hand or wrist than your waist. That is one of the reasons that children's hoops are not easy for adults to spin around their waists. The other reasons are weight and traction. By increasing the weight, friction and size of a hoop, an adult finds it easier and easier to spin around their waist.

As the hoop is made to circulate various parts of the body—the waist, the hips, the thighs, the knees, the chest, the arms, the neck and the hands, the patterns change with the speed, momentum and change of directions that the hoop makes. The signals coming from the sensor at any one moment allows the extrapolation of the shape of the spiral that the sensor is moving along. The hoop thus "knows" what part of the body it is moving around and in what sort of shape and the display is modified accordingly. As an example, one program to interpret the signals coming from the sensors has the color of the lights and the pitch of the sounds change, based on the position on the body. It appears quite magical.

The balance of a hoop is important if it is to be an instrument that responds coherently with the movements of the user. The placement of the batteries is important to the spinning of the hoop, particularly when it is thrown in the air, as is done by rhythmic gymnasts and hoop performers. By placing the batteries and internal components so that the weight is balanced all the way around the hoop, the performance of the hoop is improved. It spins truer and doesn't wobble, and is easier to keep moving steadily on certain paths. When you want a steady smooth sound transition or color trail, you need a steady input. If you lower the sensitivity enough to disguise a wobble, then you render the hoop less responsive.

The present hoop construction allows the hoops to be used for rolling along the ground, for dancing with, for holding between two people, for martial arts practice, for all varieties of play and exercise, for meditation and for performance. One can spin a hoop that has extreme variations of weight and size and texture etc. Hoops that are 13 inches in diameter can be spun around the arms, and are used in exercise routines. The American Indians use hoops that are approximately a couple feet in diameter. They measure the height of a person and use that as the circumference of the hoop. This allows the use of several hoops spinning in different ways at the same time on different parts of the body. I have made extremely large hoops (over six feet in diameter) and they are useful to train beginners who have large girths. Within reason (the flexibility of the hoop material, the weight of the hoop, the strength of the user) . . . the larger the diameter of the hoop relative to the waist or hips or chest or thighs of the performer, the easier it is to spin the hoop and learn some basic skills. One must also consider that the hoop spins faster the smaller its diameter (relative to the size of the hub or body). Many tricks are easier to do with a smaller hoop. For its use as an instrument that can be played with the whole body (the torso and limbs and head) as well as in the space surrounding the body (moving the hoop with the hands or feet or spinning it in the air) a smaller, lighter hoop is preferable. If it gets too light it doesn't have the momentum necessary to make it follow a steady path back up the body, if it is too heavy, the inertia causes it to be sluggish in changing directions and it can be difficult to do hand movements with. So a balance of these factors is necessary to give the feel and performance that is best suited to the person. The smallest hoops that will spin around any point of the average body, and respond fast, would be around 35" diameter, though smaller hoops of 13 to 22" are good for juggling and rotating around arms and hands while using other hoops. The largest ones that I normally make are around 54" diameter, and two people can be inside this hoop when it spins.

The hoops I currently prefer as instruments that have the greatest range of motion, responsiveness and potential of expression are around 39 to 42" diameter, with 40.5 being the peak for most people. This hoop is too large to carry through some security equipment at airports or to fit into ones luggage. That is one of the reasons I make the hoop with a connector, so one can pull it apart and tape (and/or screw) it together.

Having the hoop be easily recharged obviously makes the instrument easier to use.

The original "hula-hoops" of the 50s were made of polypropylene and high density polyethylene, and these plastics still work for the tubing, though many more varieties of plastics can be used, especially low density polyethylene or MDPE or PEX etc and the wall thickness can now be controlled to provide the right combination of flexibility, weight translucency or opacity, strength, and 'feel'. Most of the tubing nowadays is black or orange or colored in some way, and for the lighted hoops it obviously works better to stay with a natural, "white" or clear tubing.

Both the inside and outside of the hoop is taped. The tape on the outside serves to increase traction between the body of the user and the hoop itself. The better the connection between the hoop and the user, the more directly one can play the instrument with the whole body. Where the tape would interfere with the lights, sandpapering the outside of the tubing on its inner curve serves the purpose of increasing traction and grip. The tape on the outside also serves to break up the trails coming from the lights and create more detailed patterns of color and light. This gives the display more resolution. The taping of the hoop adds variety and depth to the trails produced, helping to provide displays that are interesting, beautiful and responsive to the movements of the performer or user. The clear tape on the inside serves to hold the components together and thus to prevent damage to them. It also acts to dampen the extraneous sound from inside the hoop. The sounds the user wants from the hoop are not the wires and LEDs banging around. A further function of this tape is to add depth to the display. FIGS. 18, 18A-C illustrate this. The tape is wound around the internal components and crinkled to provide a multitude of surfaces for light diffraction. The source of light is then diffused without losing any brightness and the tube looks like a crystal filled with light rather than an empty tube. In an instrument designed to provide light and sound, aesthetics are a consideration and contribute to the effects produced. Taping the hoop with varying widths of tape, and varying opacities of the tape, makes different shapes on the hoop and affects the trails and display produced. Transparent holographic, laser or iridescent tape can also be used on the outside of the tubing. The tubing itself could also be created with patterns in it, or with an opalescent effect.

This taping alone, even with simple one color LEDs or EL wire in the hoop, allows the performer to generate a multitude of patterns, by varying speed, direction, and rotation of the hoop. Already, without the addition of any further electronics or computer control, we have an instrument that can reflect the mood and intention of the performer, giving them feedback, and informing them directly as to the quality of their movements, and displaying that interaction to an audience or other hoopsters. The addition of circuits and switches and sensors and wireless, then adds depth and intricacy to this. The further addition of the audio feedback either to the performer alone through wireless headphones with onboard samplers or to an audience through a synthesizer and speakers, then gives even more scope to this instrument as both an entertainment and artistic device. The control of the lights is not done from an outside source. The performer, user or "hoopster" is the one controlling the display of light, color and sound, thus keeping the synergistic effect of the movement, rhythm and tone and color and patterns of light all being synchronized through the movement of the hoop.

The shape of the hoop itself confers an advantage. It is an instrument which can be played by the whole body. Most musical instruments have been played with the breath or fingers, but now with wireless technology we have the capacity to translate different kinds of input signals, and generate the signals for creating whatever sounds we like electronically. Other shapes have disadvantages in group situations where one does not want any sharp, threatening or pointed objects. Also the hoop shape is ideal for spinning, rolling, twirling, throwing and catching like a ball, juggling, rotating around the body and limbs and so forth. The shape of the hoop makes it ideal for bodies of all sizes and shapes and ages:

Having the hoop respond to movement, either through mechanical arrangements and switches such as the ball bearing and the contact switch and pressure sensors and MEMS and accelerometers and so forth, makes the hoop come alive and generate real interest and possibilities as an instrument, and not just as an amusing rotating Christmas tree thing . . . . It thus holds interest for a longer time and can act as both an entertainment device and one that provides learning opportunities through its feedback.

Another advantage is in being able to use a variety of light sources, from simple single color LEDs to multiple colors, to LEDs with onboard ICs and their own programmed mixing of colors, to EL wire of either one color or multiple colors in different strands, and having those EL wires either just be able to turn on and off, or have them animated through sequencers that can run their own patterns and/or respond more directly to the movements of the hoopster. Another advantage is in having the capacity to use UV LEDs along with the other LEDs, or on their own, to illuminate the black light sensitive clothing of the performer. This transfers the light patterns onto the clothing or paint on the performer's body and as the hoop spirals in and out from the body, produces interesting and repeatable effects and patterns.

The synthesizer hoop is in some embodiments equipped with a receiver as well as a transmitter. This allows signals from other hoop instruments or equipment to be routed through a central hub to the hoop itself. This is not a primary function of the instrument. The main function of the synthesizer hoop instrument is for the user to generate the lights and also the sounds that they dance or hoop to. It is not the primary intention to turn the hoop into a passive display system, that for example, pulses with the beat of the ambient music. It can be done, but then the hoop is no longer functioning so much as an interactive instrument. The design of the hoop encourages the user to generate the displays of color, light and sound through the movements of their own body.

Many other shapes and styles of portable synthesizer instruments can be imagined, but this invention consists only of a hoop shaped instrument that can be spun around the whole body and all of the limbs, and moved in various ways in the space around the body. The hoop shape encourages the most interactivity and movement, while being safe in crowded places and relatively unbreakable. Many systems for tying sound and visual display together have been created in the previous hundred years, from keyboards that made different colors to video synthesizers and computer animated systems . . . the combination of sound and imagery or pattern is a constantly fascinating one. The hoop is an ideal instrument for the movement-based synthesis of sound and color.

Just as many keyboards can be set to play by themselves, so can the displays be generated automatically, but that is a minor function of the synthesizer instrument. Its intention is to provide real-time audio-visual responsiveness. What you DO is what you get. And then what you get affects what you do. That is the instrument part of it. The aim is to have the instrument be coherent, where the sounds and colors are coordinated perfectly with the movements of the user. This gives a different feel to the instrument. There is more interest and excitement in viewing the performance. It feels alive to the user. Having switches that respond to acceleration, motion, impact and so forth, adds a lot more variety to the lighting effects and synchronizes the range, speed and type of movement of the hoop with the light colors and patterns. This adds a lot more to the performance and invites the performer to exercise for longer periods. The way the colors vary with the speed and actions of the performer gives much more information about the movements of the hoop to both performer and audience. This information can be used by the performer as a direct reflection of their movement and intentions, rather like a biofeedback device, and allows for a rapid gain in proficiency with the hoop, so this really does function as an instructive device.

Indeed, the hoop can be used (indoors) to great effect in the daytime, which has not been the case with previous lighted hoops. The sound function can operate on its own and so even in bright sunlight the user can get real time feedback from the hoop or perform with it as an audio instrument. The taping of the hoop includes tape that reflects bright lights in dazzling ways when the hoop is spun. This adds to the appeal when the hoop is being used in situations where there is too much ambient light for the internal lights of the hoop instrument to have much effect.

In Maleyko U.S. Pat. No. 4,915,666 1990, the lighted hoop is described as having 20 sections. This would make the hoop unwieldy to a performer, and my hoop has only one or two joins, which are seamless. Maleyko states that his LEDs are separated by retainers make of foamed plastic plugs. My invention requires no retainers as the LEDs are attached to a firm but bendable wire that extend all the way around the inside of the tube and forms part of the lighting circuit. In some embodiments of the synthesizer hoop, white foam sheets (FIGS. 16B, 16C) are used in the hoop to reduce internal noise and to bounce light rays. An improvement on this is the arrangement of clear or clear iridescent tape (FIG. 18). The LEDs can also be on circuit boards, or soldered to thin strips of material that has insulation in the middle and a conducting surface on both sides.

Maleyko also states that the LEDs may be of different colors, but has no provision for LEDs that have ICs on each one with three different colors on each so that patterns and trails and rainbows are produced. Also new here are the mechanisms for varying the display and making it more interactive—these mechanisms including switches that are controlled by acceleration in different dimensions, by movement, impact, momentum etc. The intensity of the light thus varies, as do the colors and sequences of color, the trails and rainbows etc, and the hoopster (hoop performer) is given much more information as to the speed, rhythms and pathways that the hoop is traveling on.

By installing UV LEDs in the hoop, controlled by a separate switch, the white, and day-glo colors of the performer's clothes are highlighted and interest is generated that way. These UV LEDs in the hoop provide dramatic effects in performance with day-glow clothing or props. Note that the UV LEDs require small windows to be made in the walls of the tubing to allow the UV light to escape. Otherwise the walls of the tube absorb a significant proportion of that light.

Maleyko describes the hoop as having multiple sections that can be assembled, which is convenient for packaging. The design of this hoop, however, allows the overall diameter to vary from less than 2 feet to over six feet. The hoop slides apart and the ends slide past each other to make it convenient to take on planes or send by mail.

The spiral pathway is modified by the diameter of the axis that the hoop is turning around, and this creates predictable differences in pattern depending on what part of the body is being used as the focal point. No one seems to have worked with this behavior of a hoop before. The hoop is repeatedly referred to as a toy, and though my invention does not preclude its use as a toy, it indicates use as an instrument, that can express the mood, intention and artistic creativity of the user. This is accomplished by taking into account the differences in the pathways of the hoop based on its position on the body. A hoop revolving around a waist has a different display and makes a different set of sounds than one revolving around the neck or knees or wrist and so on.

Having switches that respond to acceleration, motion, impact and so forth, adds a lot more variety to the lighting effects and synchronizes the range, speed and type of movement of the hoop with the light colors and patterns and with the sounds generated. This adds to the performance and invites the performer to exercise for longer periods. The way the colors vary with the speed and actions of the performer gives much more information about the movements of the hoop to both performer and audience. This information can be used by the performer as a direct reflection of their movement and intentions, rather like a biofeedback device, and allows for a rapid gain in proficiency with the hoop, so this really does function as an instructive device.

To develop a mastery of any instrument takes familiarity, practice, and purpose. It is not much different with the Synthesizer Hoop. As the user's skills with the instrument increase, a wider range and more pleasing displays are generated. There is an integration of sound, color and movement. This acts to further encourage practice and play. Thus exercise is promoted. The user can't master the full range of this instrument while sitting on a couch. Dexterity, flexibility, fitness, range of motion, sensitivity, and rhythm are all developed in discovering the possibilities of the instrument. Because the lights, colors, trails, tones and rhythms are all being synchronously generated through the movement of the user (performer, hoopster, player, practitioner) there is the potential for a coherent synergy to occur that some might call art. A sense of wonder is often present. One of the differences between the synthesizer hoop and some more conventional instruments such as the violin or flute is that the hoop instrument doesn't take as long to learn. You can have fun with it and generate great patterns and sounds from the get go, Your range might be limited at the start, but you can still have fun instantly. The hoop instrument is also geared toward improvisation. The Synthesizer hoops can express different moods, communicate a variety of feelings, and inform the user. The synthesizer hoop can function as an audio-visual mirror, reflecting interesting aspects of the user's current attitude and state. In other words it can be instructive. Entertainment, instruction, exercise, play, creativity, expression, dance, and bliss. Guaranteed! Well, be that as it may, I am just trying to make the point that this interactive synthesizer hoop instrument is not just a hula-hoop. It is a whole lot more.

Object of the Invention

The object of the invention is to provide a means by which the exploration of personal movement is encouraged through the generation of synchronous and synergistic light and sound patterns. It makes the hoop more fun and deepens its range, opening it up as a communication device, a light synthesizer and a musical instrument.

SUMMARY

I have invented a hoop that takes the "hula-hoop" to a new level, transforming it from a child's toy to an instrument that can be used by people of all ages and sizes and skill levels, for exercise, play, entertainment, education, communication and art. It is a light and sound synthesizer that is played through rhythmic movement, creating patterns of lights and sequences of sounds that synchronize with the movements of the body and create a synergy of sensation and perception in the viewer and performer.

DRAWINGS

Figures

Figure 10A:
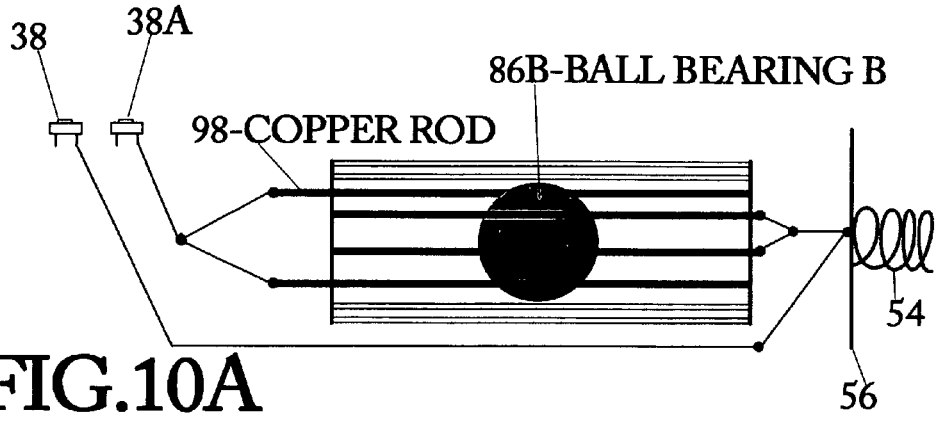
Figure 10B:
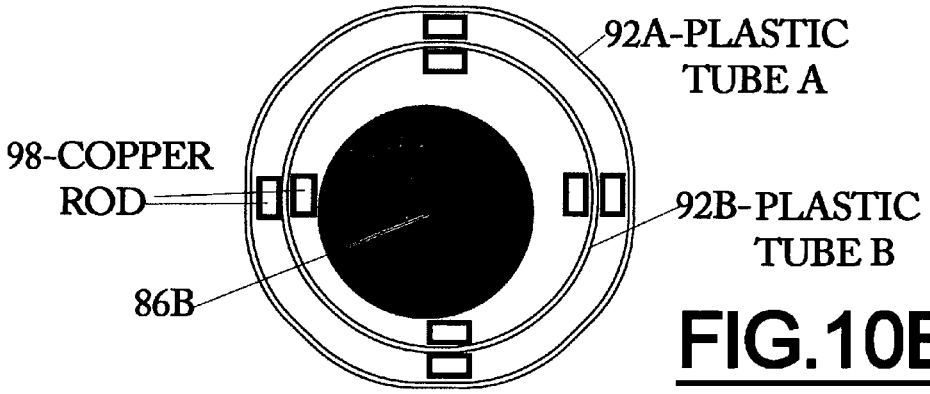
Figure 10C:
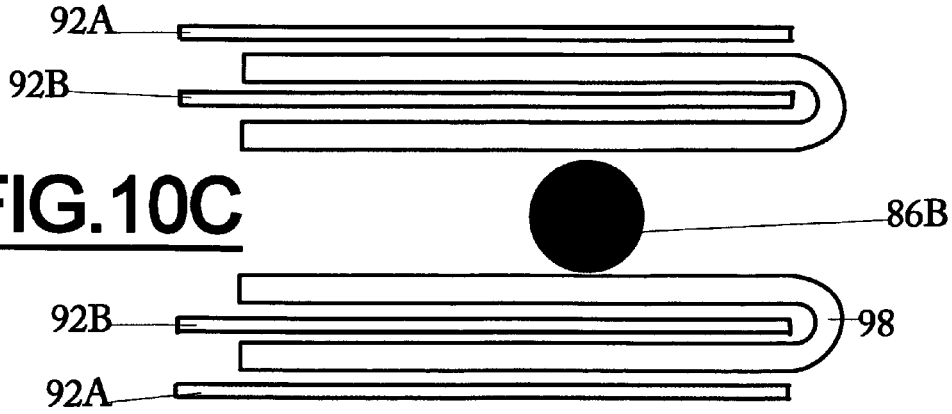

FIGS. 10A, 10B, and 10C show side, plan and detailed views of an electromechanical sensor.

Figure 11A:
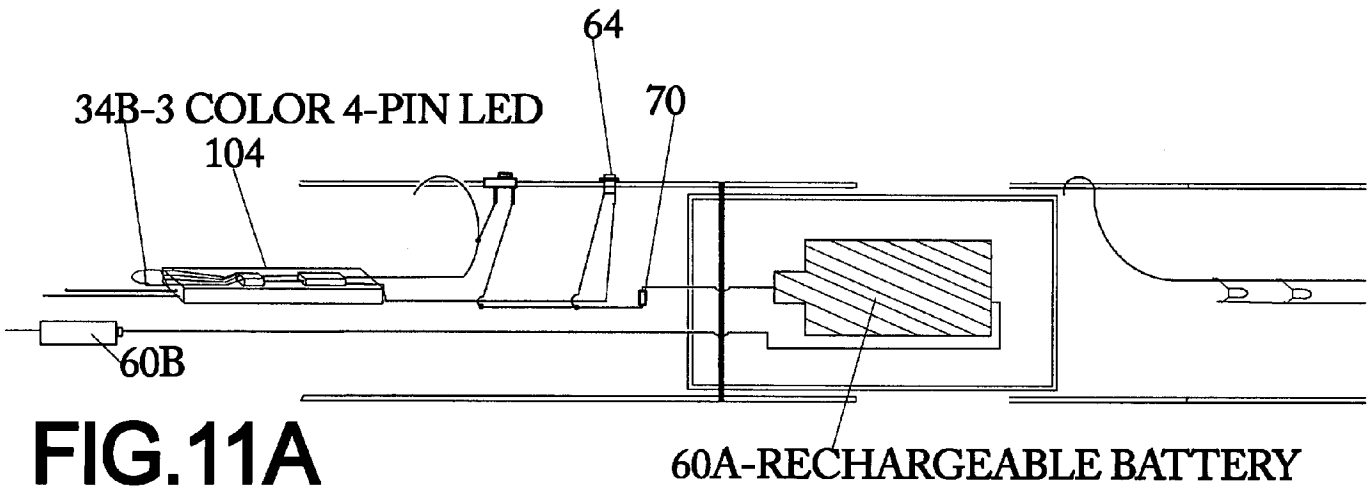
Figure 11B:
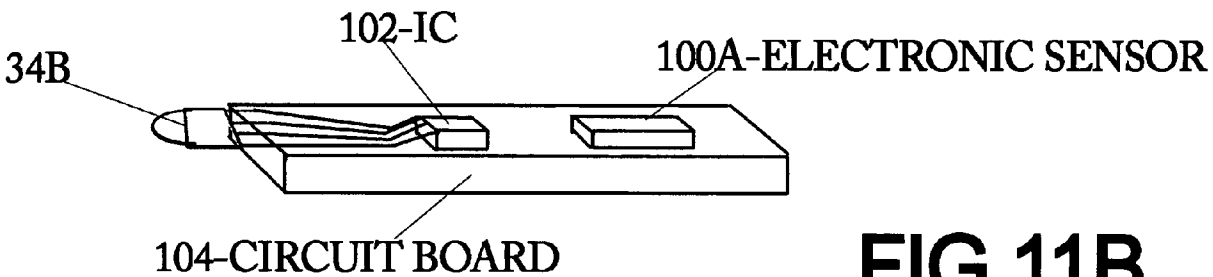

FIGS. 11A and 11B show side and perspective views of an electronic sensor.

Figure 12B:
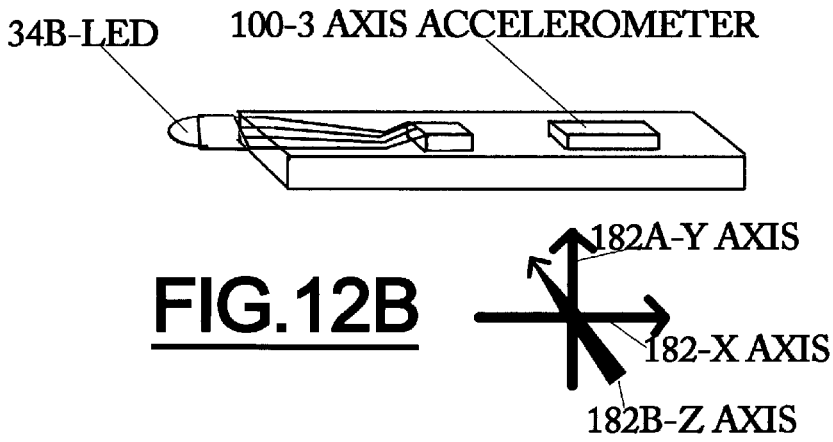
Figure 12A:
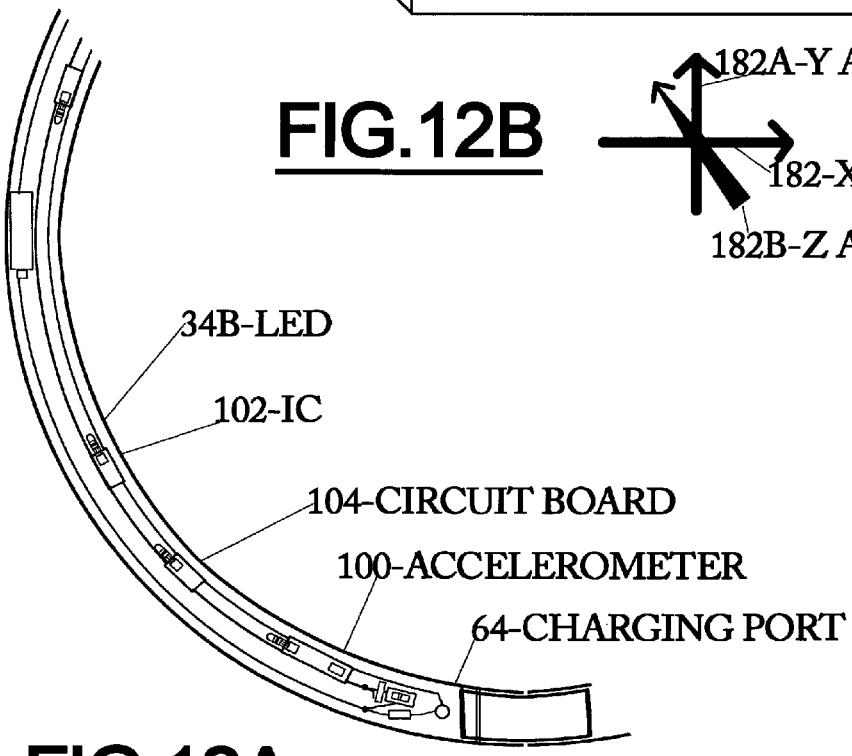

FIG. 12 shows a plan view of a section of hoop with accelerometer and ICs.

Figure 13:
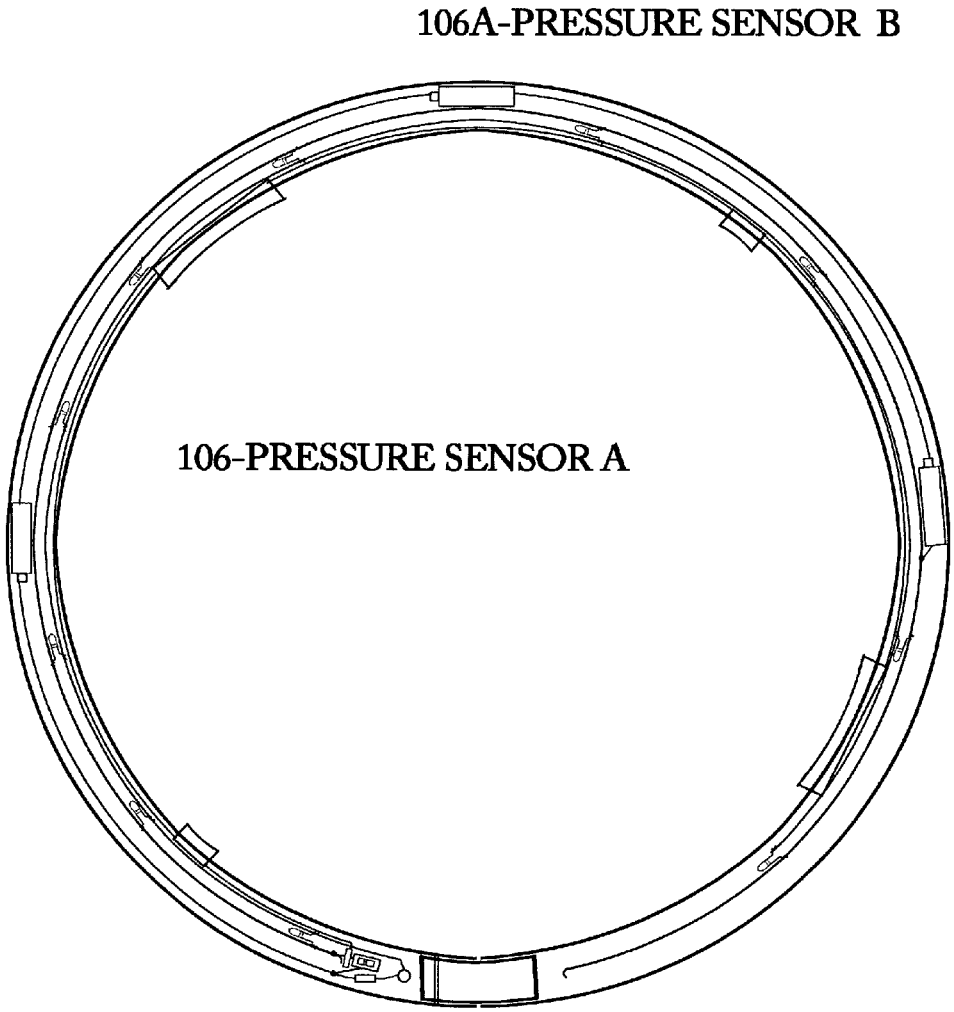

FIG. 13 shows a plan view of a hoop with pressure sensors.

Figure 14:
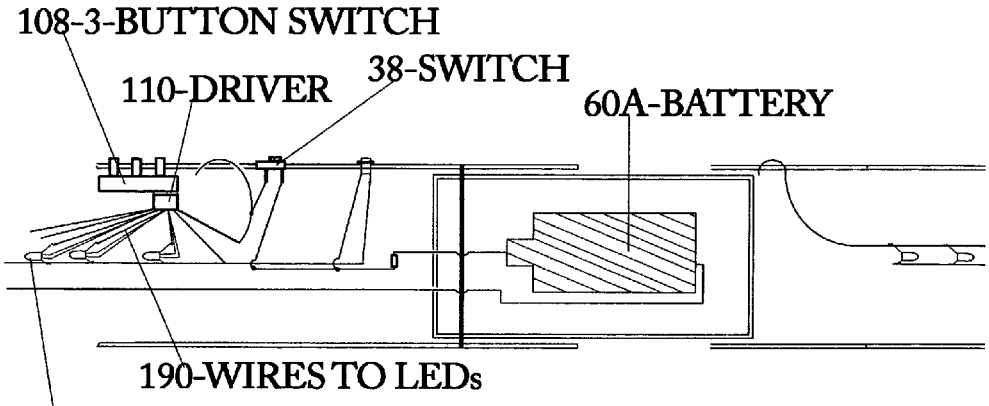

FIG. 14 shows a detailed side view of a button switch for a sequencer

FIGS. 15A, 15B and 15C show view of EL wire in a hoop.

Figure 16A:
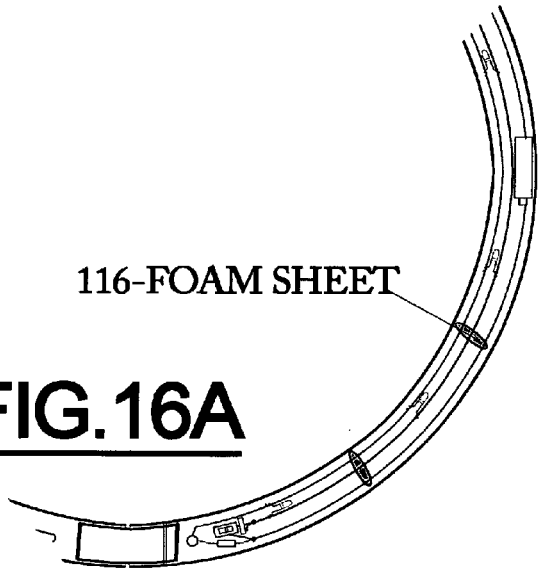

FIG. 16A shows a section of a hoop with sound reduction system.

FIGS. 16B to 16H show details of sound reduction systems.

Figure 17A:
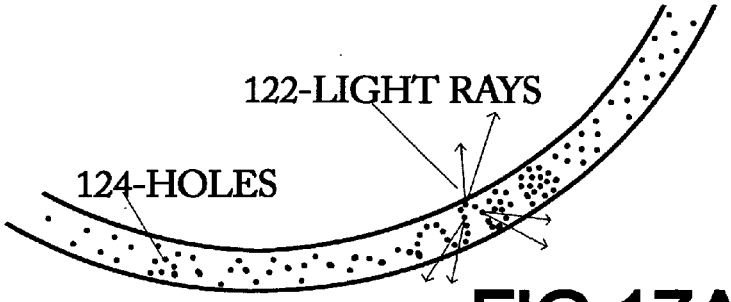

FIG. 17A shows a plan view of a section of a hoop with holes in it.

FIGS. 17B to 17F show detailed views of light reflection/refraction systems.

FIGS. 18, 18A, 18*b* and 18C show more detail views of a light refraction system.

Figure 19A:
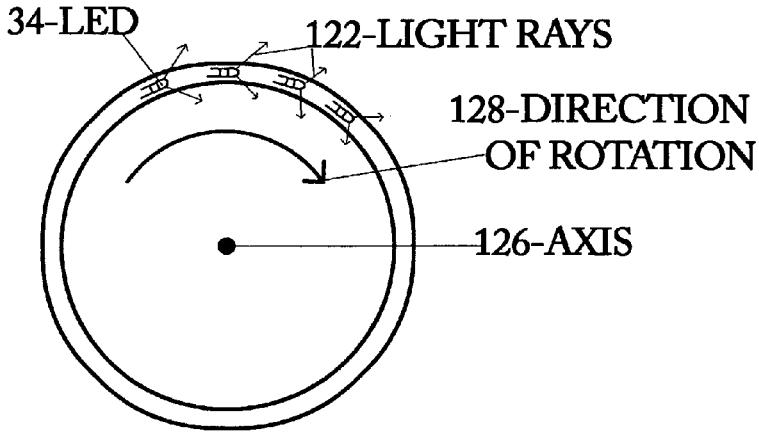
Figure 19B:
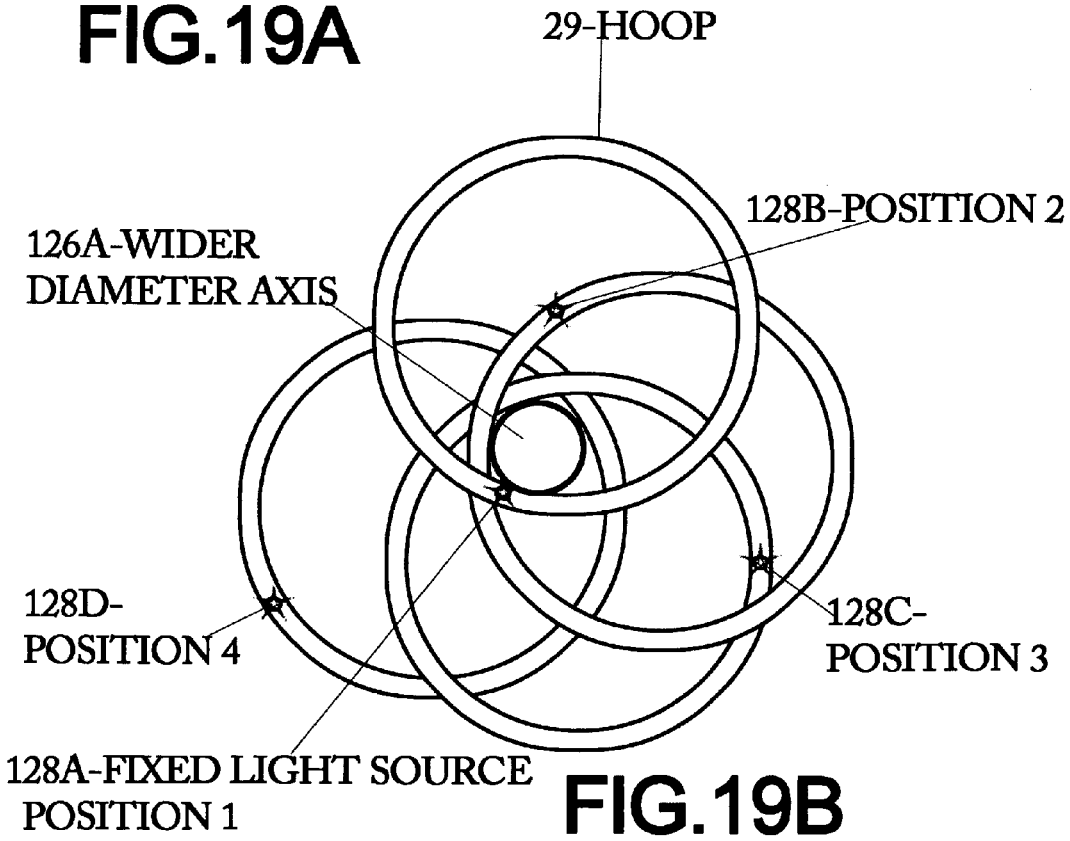

FIGS. 19A and 19B show the path of a point in a hoop.

Figure 20A:
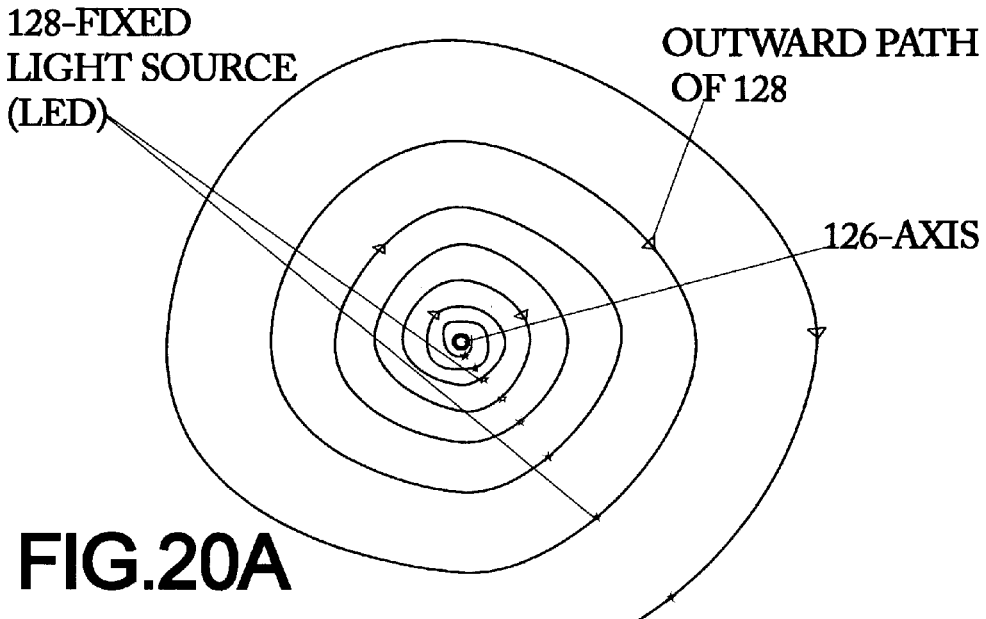
Figure 20B:
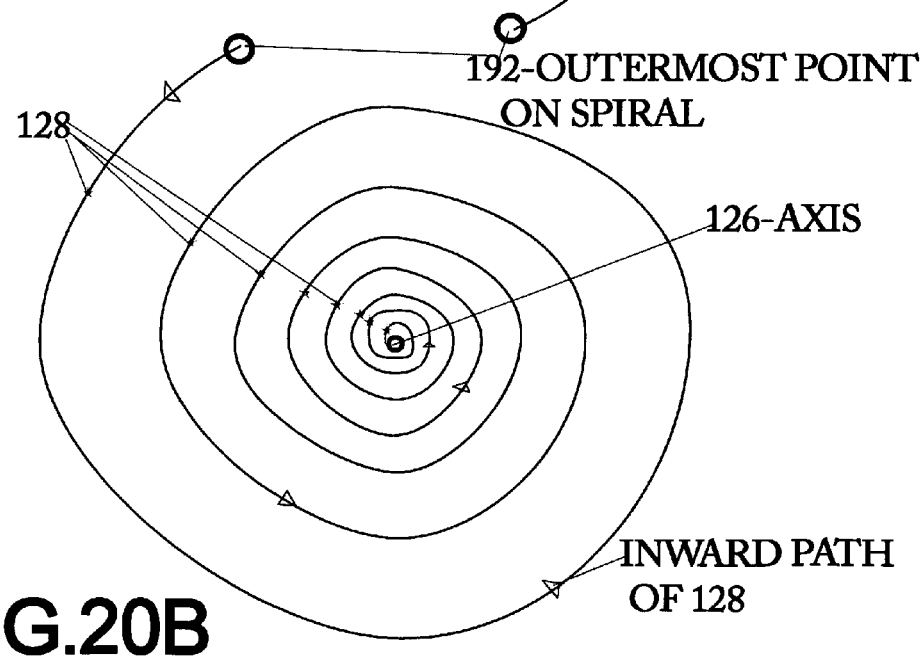

FIGS. 20A and 20B show plan views of the path of a point in a hoop rotating around a wrist.

Figure 20C:
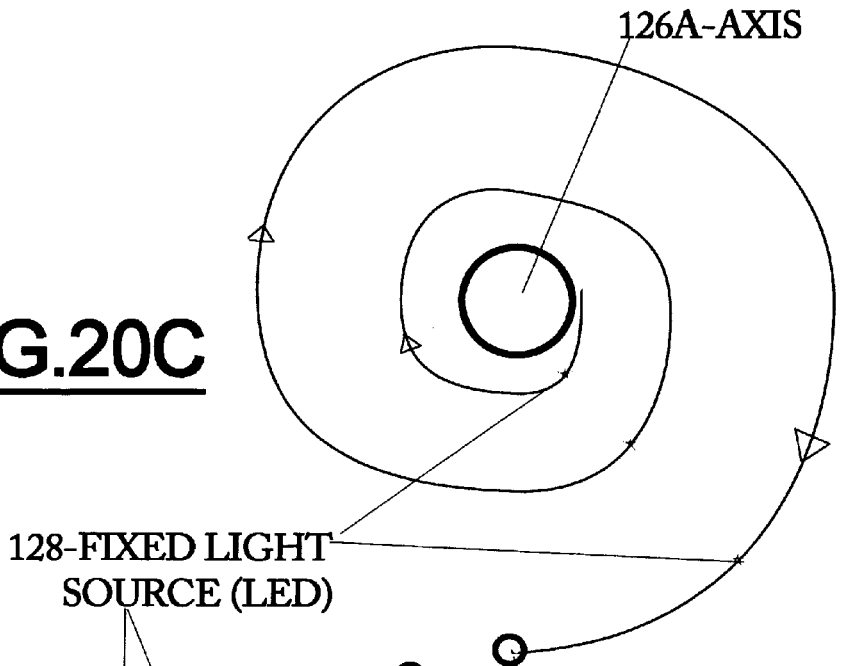
Figure 20D:
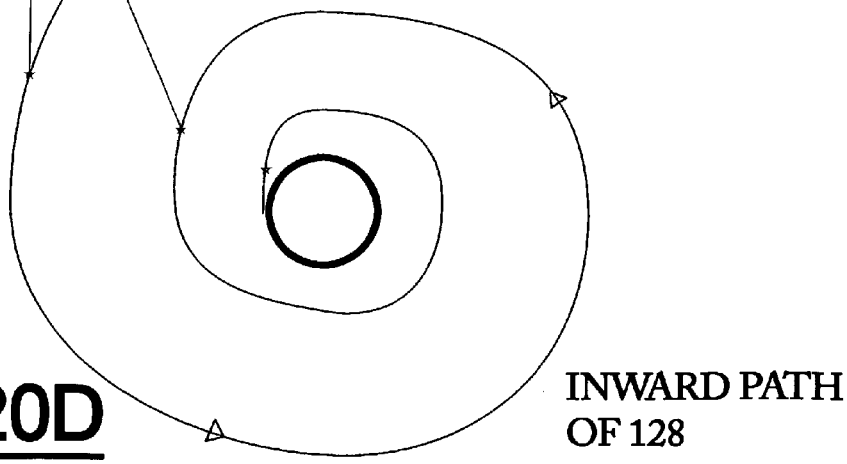

FIGS. 20C and 20D show plan views of the path of a point in a hoop rotating around a waist.

FIGS. 21A to 21C, 22A to 22C and 23A to 23D show plan views of trail shapes left by a lighted hoop.

FIGS. 24A to 24F and 25A to 25C show some paths of lights in a moving hoop.

Figure 26B:
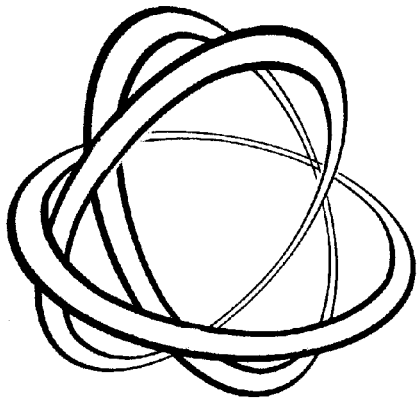
Figure 26A:
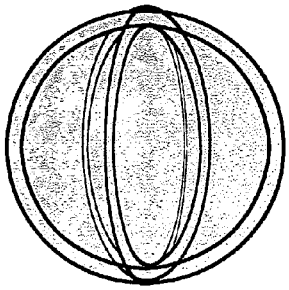

FIGS. 26A and 26B show some shapes that a moving hoop can form.

Figure 26C:
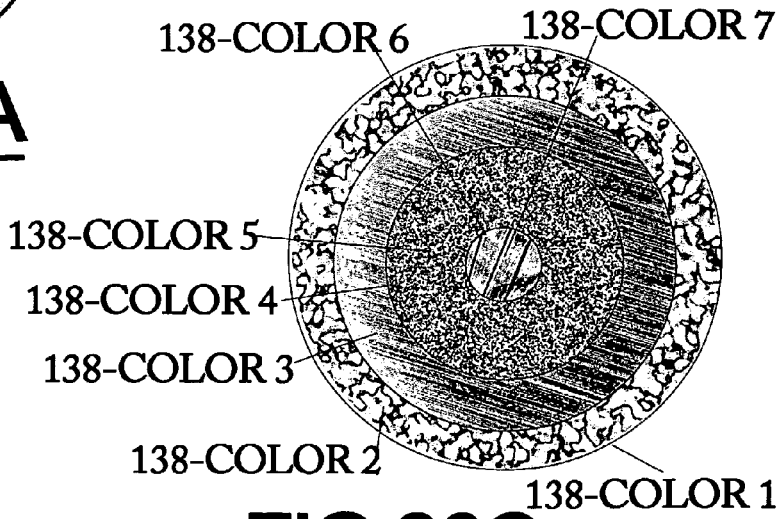

FIG. 26C shows a pattern that a spinning lighted hoop can make.

FIGS. 27A-H and 27J show views of performers with hoops making different trail patterns and shapes.

Figure 28A:
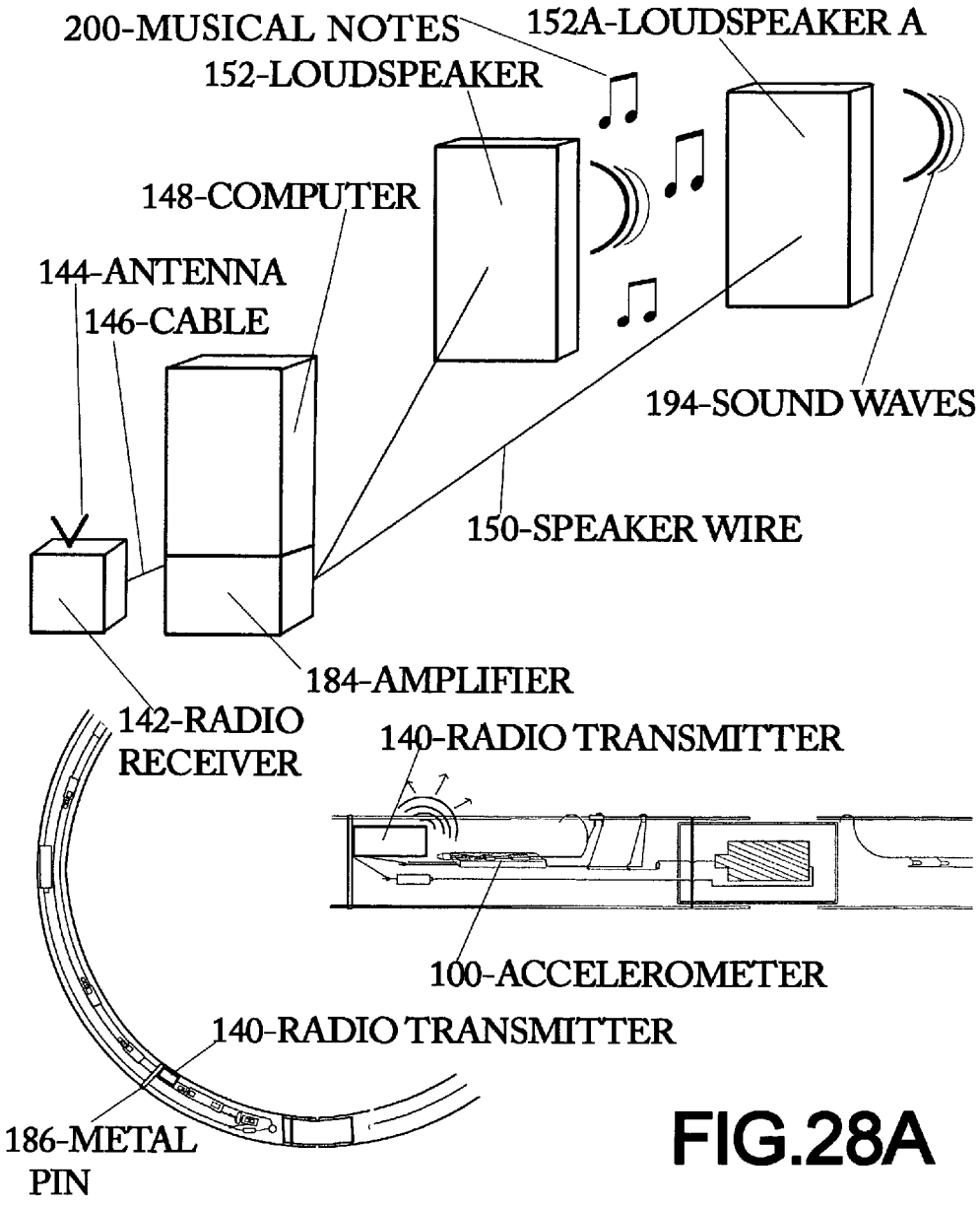

FIG. 28A shows an overview of a hoop with a wireless system.

Figure 28B:
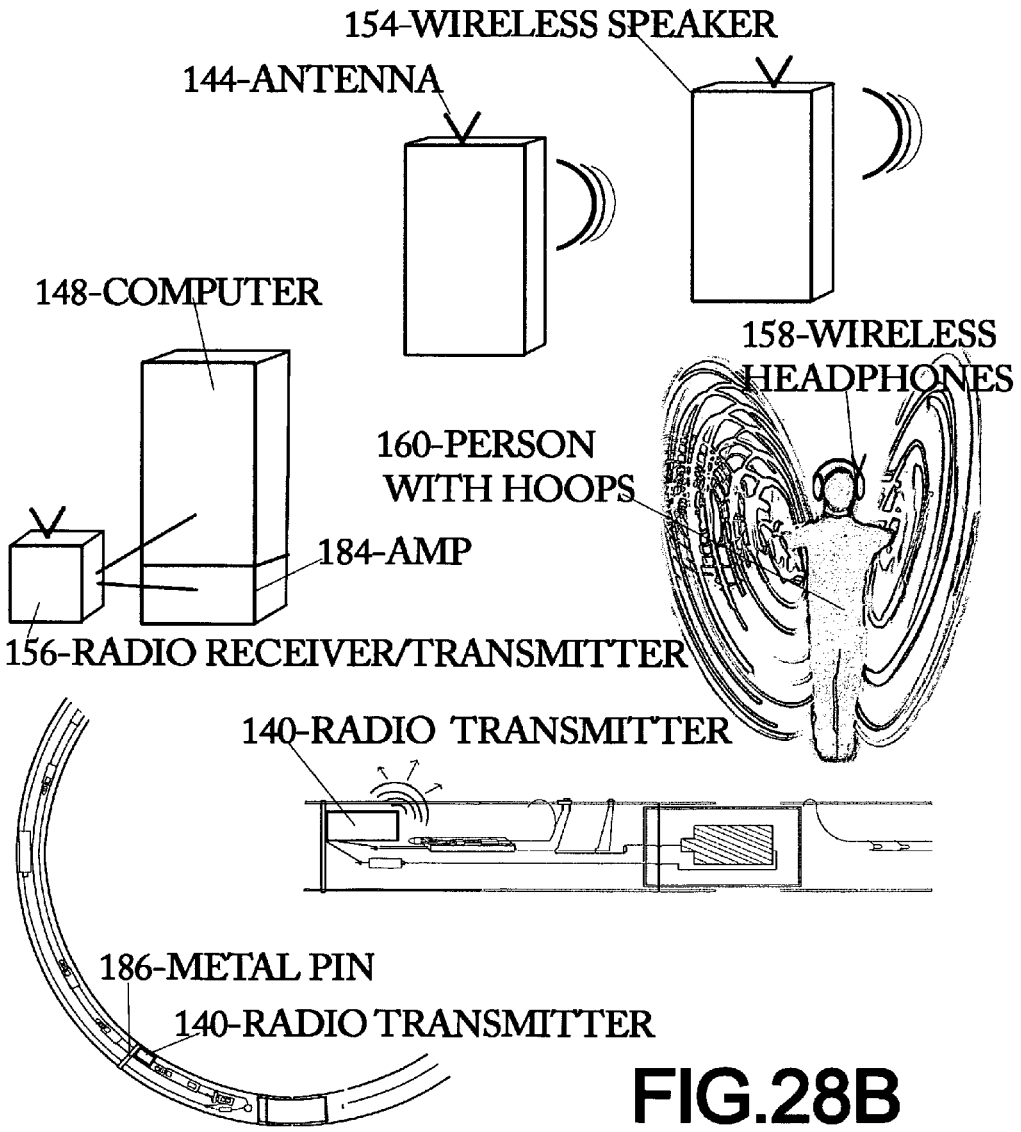

FIG. 28B shows an overview of a performer with headphones and wireless system.

Figure 28C:
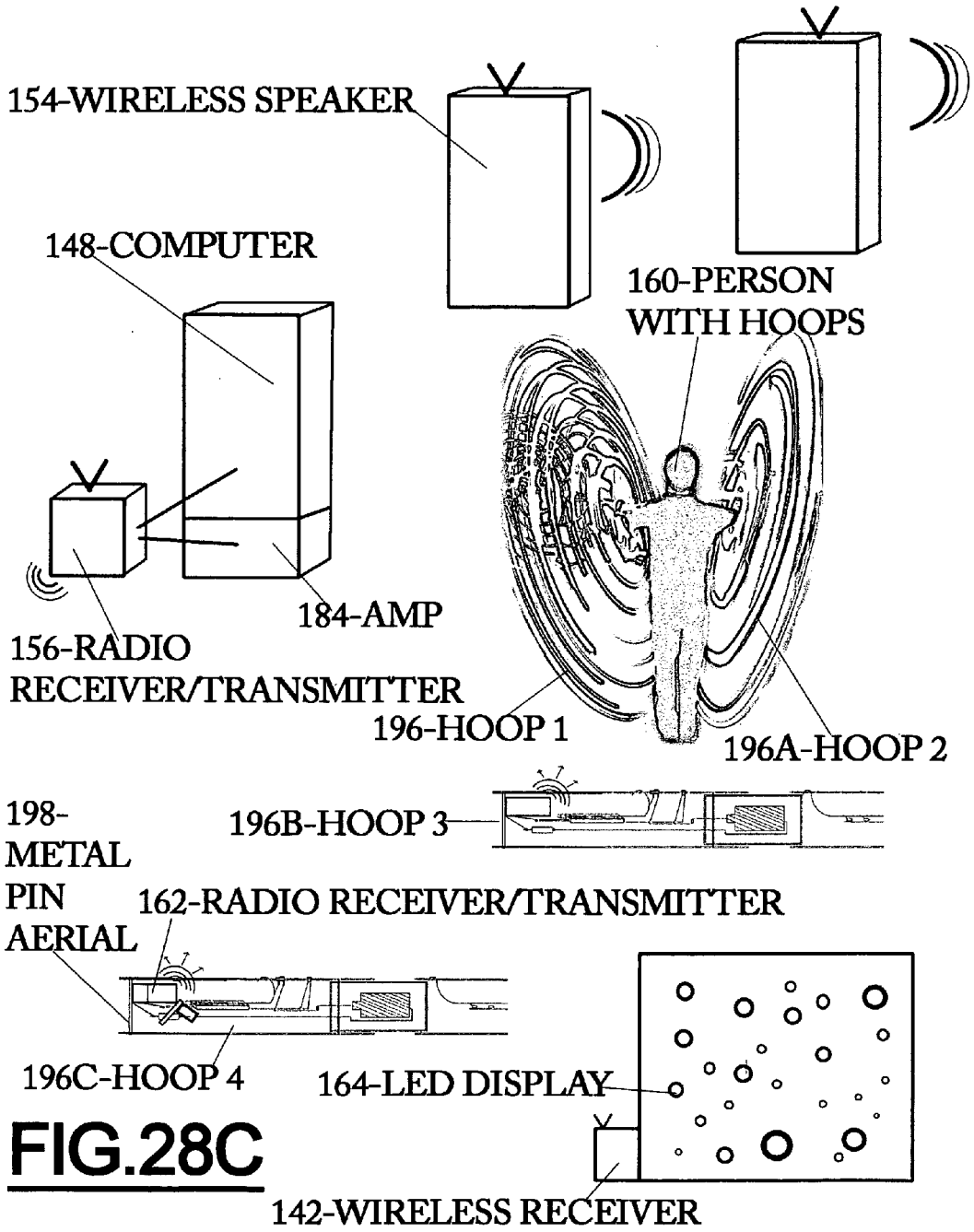

FIG. 28C shows an overview of a performer with another embodiment of a wireless system.

DETAILED DESCRIPTION

Figure 1:
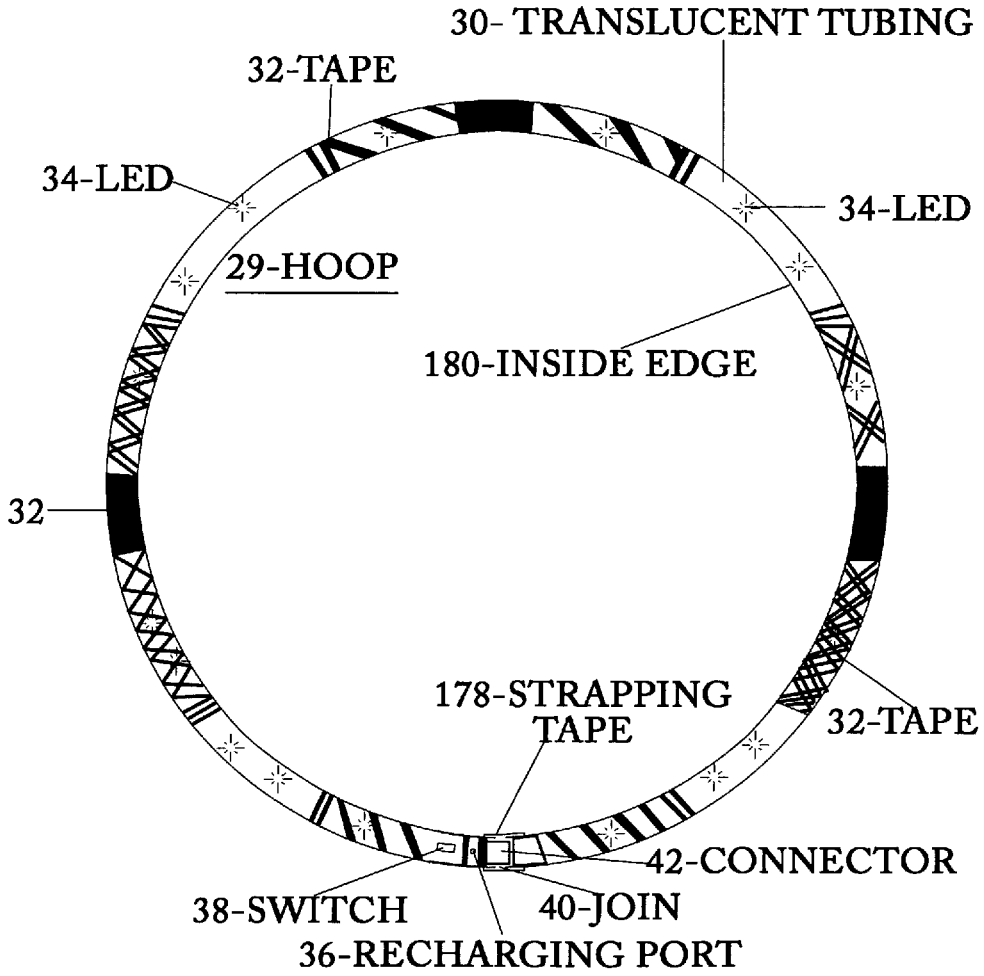
FIG. 1 shows a plan view of an assembled hoop.
Figure 1A:
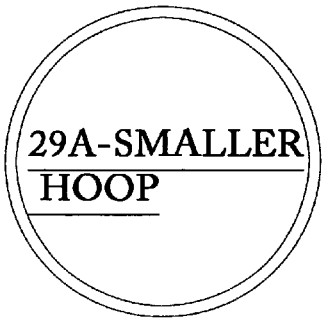
FIG. 1A shows a plan view of a small hoop.
Figure 1B:
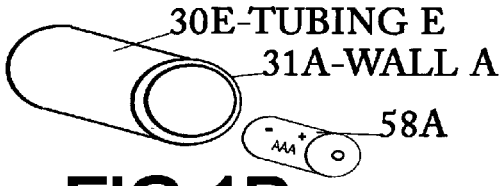
FIG. 1B shows a perspective view of the cross section of the tubing of a small hoop.
Figure 1D:
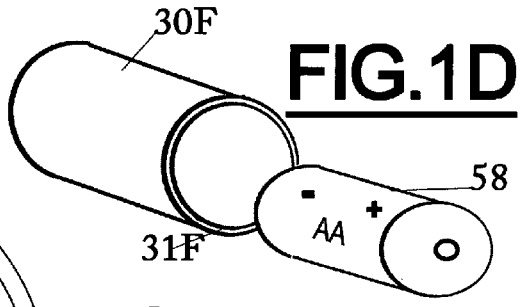
FIGS. 1D, 1E and 1F show perspective views of the cross section of different sized tubings.
Figure 1C:
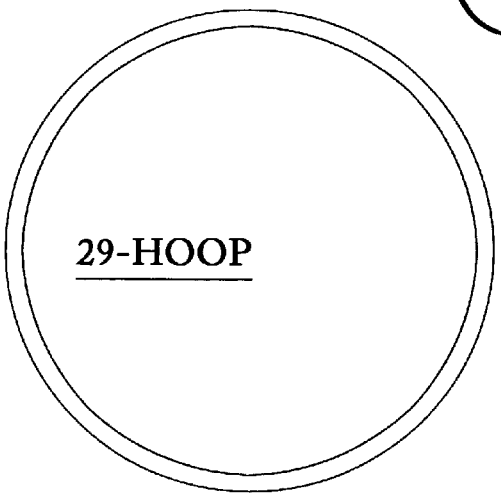
FIG. 1C shows a plan view of a hoop.
Figure 1E:
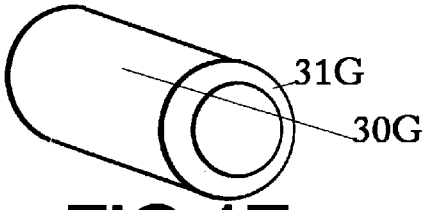
Figure 1F:
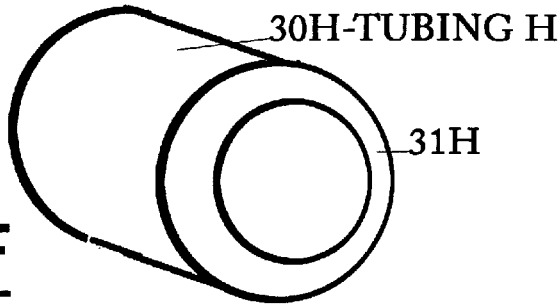
Figure 5:
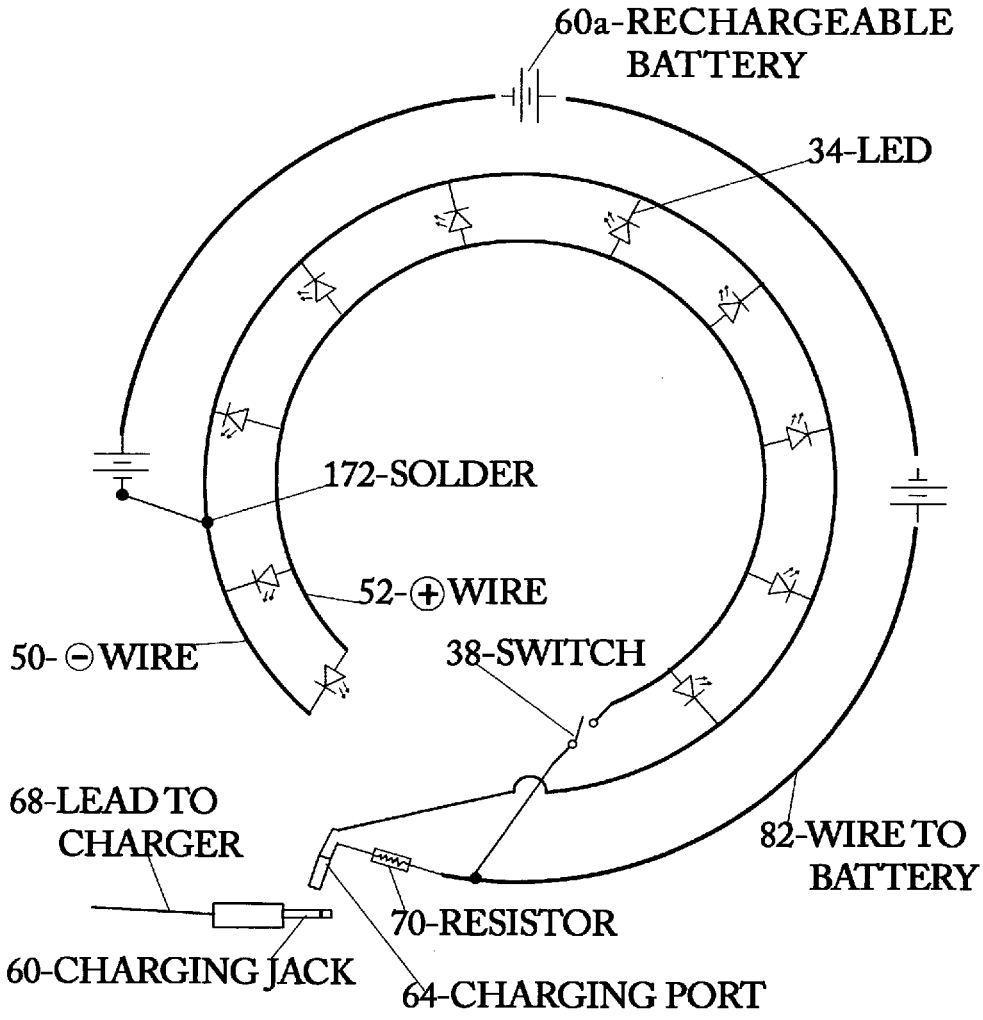
FIG. 5 shows an electronic schematic of a circuit for a rechargeable hoop.

Preferred Embodiment—FIGS. 1,1A to 1F,2,5,6,6A, 8A,10A,10B,10C,11A,18, 18A, 18B,18C, 28C A preferred embodiment of the outside of the invention is shown in FIG. 1. A hoop is shown. The hoop is taped 32. The tape used on the outside of the hoop has adhesive on one side of it to cause it to stick to the tubing. Tape 32 most commonly is from 0.159 cm (1/16 inch) to 5 cm (2 inches) in width. Most of the tape is cloth tape. Tapes with varying degrees of translucency are used, as well as metallic tape and holographic or laser tape. The hoop is constructed from tubing 30. The tubing is made from translucent plastic. In the preferred embodiment, the plastic is polypropylene, though it can also be made from low density polyethylene (LDPE) or high density polyethylene (HDPE) or any plastic material that has similar properties of translucency and flexibility and durability. The wall thickness of the polypropylene depends on the diameter of the tubing, the overall diameter of the hoop, and the characteristics of flexibility that are required for that particular hoop. FIG. 1A shows a "smaller" hoop. For these purposes what is meant is a hoop from 0.559 meters (22 inches) to 0.99 meters (39 inches) in diameter. The wall thickness 31 (FIG. 30) is best at around 0.15875 cm (1/16 inch). The overall outside diameter (OD) of the tubing is 1.905 cm (3/4 inch). The mid-sized hoops (FIG. 1C) are made with diameters ranging from 0.9144 meters (36 inches) to 1.1176 meters (44 inches). These work best (FIG. 1D) with wall thickness of around 0.238 cm (0.09375 inches). The OD of the tubing is 2.54 cm (1 inch). If more stiffness is desired (see operation section) a wall thickness of 0.3175 cm (1/8 inch) is used (FIG. 1E). This size, can also be made with a tubing OD of 3.175 cm (1.25 inches), and the same wall thickness. The largest hoops in the preferred embodiment of this invention are made with overall diameters between 1.016 meters (40 inches) and 1.3716 meters (54 inches) and they require a wall thickness of 013175 cm (1/8 inch) and an OD of 2.54 cm (1 inch) or 3.175 cm (1.25 inches) (FIG. 1F). The tube is bought in rolls, cut to the desired length, and if necessary formed to a circle of the required diameter. Light emitting diodes (LEDs) 34 are placed inside the hoop at varying intervals (5 to 50 cm). These diodes (FIG. 6) can be of one color 34D or 3 Colors (RGB). They can also have an integrated circuit inside them 34C. The LEDs are soldered 172 (FIG. 6A) to wires 50,52,62. A wire 82 to the battery, goes through a resistor 70 (FIG. 5, FIG. 6A) on a circuit for a charging port 64. This connects to a charging jack 66. A switch 38 is placed on the circuit to the LEDs. In the case of one circuit, as in FIG. 5, a supporting wire 62 also functions as the positive wire. The supporting wire 62 is made from 16 or 18-gauge tinned copper. 2 circuits (FIGS. 6,6A) require another switch 38A and another wire 52.

A rechargeable battery 60A (FIG. 6A) is soldered in place and held by electrical tape 166. The battery 60A is held in place inside the tube by the injection of hot glue through a hole 168 which is drilled through the wall of the tubing 31. The LED 34C is further stabilized and insulated with hot transparent glue 170. The supporting wire 62 also functions to pull the assembled LEDs, batteries and wires through the tubing before gluing. The supporting wire (FIG. 8A) 62 is threaded through holes drilled in the tubing 174 and held in place by heat welding.

A connector 42 (FIG. 8A) is tooled from PEX tubing or other strong and fairly rigid plastic tubing. A length of 6.5 cm (2.5 inches) is sufficient to provide enough rigidity without distorting the curve of the hoop. The connector 42 is worked on a lathe so that it just fits the female end 48 of the tubing. The other end of the connector is left larger so that it fits permanently onto the male end of the tubing 46. The tubing is heated to allow it the connector 42 to be inserted. A brass pin 72 can be used to hold that side of the connector in place. A screw 74 is used on the female end of the connector to hold that end in place, in cases of extreme and prolonged use of the hoop.

Three AA batteries give enough power for most purposes. In this case the connector 42 is filled with a weight 84 to balance the other batteries 60A around the hoop. The weight 84 is held in place with glue 80. If the hoop needs to be made lighter, one of the batteries can be placed in the connector (FIG. 8B). Or if 4 batteries are needed, to give more power and light intensity, the fourth battery can be placed in the connector (FIG. 8B). With the smaller diameter tubing (OD 1.905 cm) (FIGS. 1A, 1B), AAA batteries are used in place of the AAs. Other types of batteries of different voltages can also be used as needed.

Figure 9A:
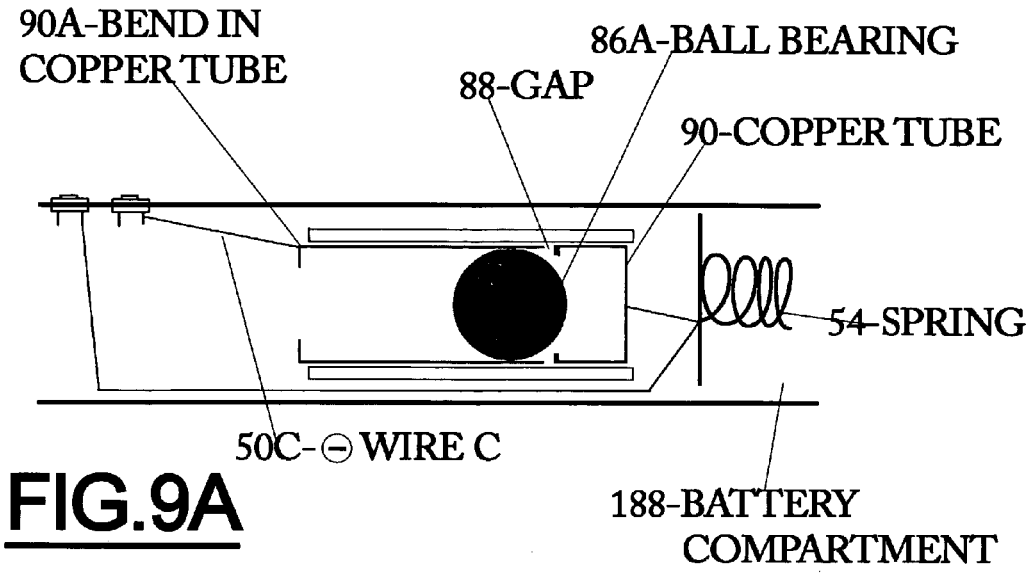
FIGS. 9A and 9B show side views of electromechanical switches.

An electromechanical sensor 176 (FIG. 6A) is placed in the circuit. These sensor/switches range from simple mechanical ones, as in (FIGS. 9A, 9B) to more complex ones as in FIGS. 10 A, B and C, and to electronic ones as in FIGS. 11A and 11B. They create different patterns of lights and are all of use in variations of the preferred embodiment of this interactive hoop instrument. FIG. 10 gives one example of a switch used to activate the lights based on hoop movement. In FIG. 10 A (side view), 10 B (cross section) and 10C (detailed side view), a ball bearing 86 is placed within a tube 92B which is of slightly larger diameter than the ball bearing. On the inside of this tube are four copper rods 98. The copper rods are bent (FIG. 10C) and held in place inside another plastic tube 92A. As the hoop moves, the ball bearing moves inside the tube and makes an electrical contact between pairs of the copper rods. The switch 38 provides a way to bypass this circuit.

An electronic sensor (FIGS. 11A, 11B) of a type known as a 3-axis accelerometer 100 is used in one preferred embodiment of this instrument. The accelerometer is mounted on a circuit board 104 and connected through an IC 102 to a 3 color 4 pin LED 34B. The hoop has a plurality of circuit boards 104 with ICs 102 and attached LEDs (FIG. 12), connected by cable or wire. More than one sensor can be used, usually 2 or 3, in which case they are distributed at equal distances around the hoop.

The wires and LEDs are wrapped (FIGS. 18, 18A and 18B) in clear or iridescent clear tape 120A which is crinkled up enough to fit into the tubing and hold the wires and LEDs in place.

In a preferred embodiment of this interactive hoop instrument, (FIG. 28A) a radio transmitter 140 is placed in the hoop connected to the electronic sensor 100. External to the hoop there is an antenna 144 and a wireless receiver 142 connected by a cable 146 to a computer 148. The computer is connected to speakers 152.

Operation of Invention—Preferred Embodiment

The hoop instrument is turned on with a sliding switch 38 (FIG. 11A) that is recessed so it doesn't accidentally get turned off or on during use. The switch is placed on the "top side" of the hoop (FIG. 1), as opposed to the inside or outside edges of the hoop, so that it doesn't get rubbed by the user's body or clothes, or by the floor if it is rolled or spun on the floor. ("Top side" is in quotation marks to illustrate the fact that the top and bottom of the hoop instrument are interchangeable. The top side of the hoop is just the side that is on top at the moment).

Figure 3A:
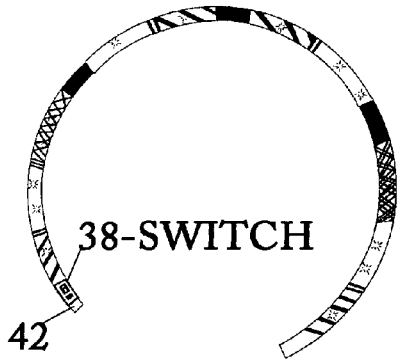
FIGS. 3A and 3B show plan views of a hoop taken apart for use
Figure 3B:
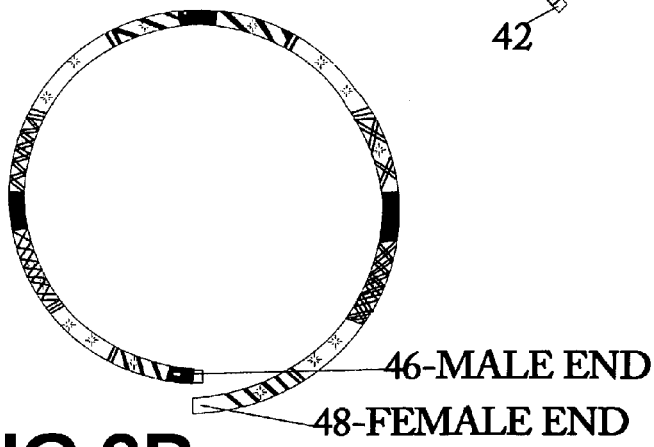
Figure 2A:
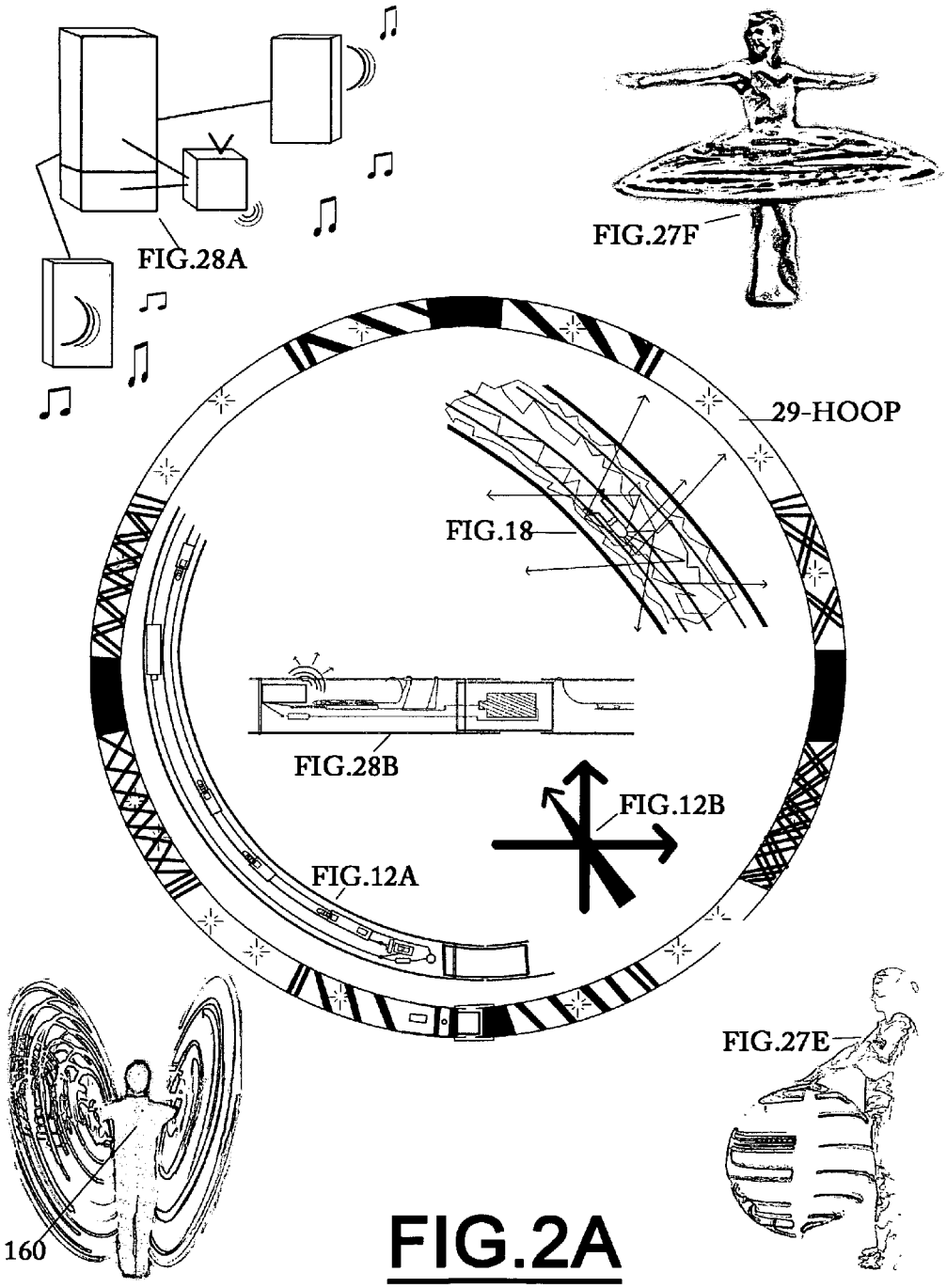
FIG. 2A shows the OG figure, an overview of the interactive hoop instrument.

Physically, the manner of using the interactive hoop instrument is similar to the use of any type of hoop, including the popularized "hula-hoop". The hoop instrument is used both by children and adults, and must withstand the rigors of performance. The hoop can be spun, rotated around any of the limbs, rolled on the ground, thrown in the air, and so on. The hoop can be spun around the ankles, the calves, the knees, the thighs, hips, waist, chest, neck, shoulders, head and face, arms, wrists, hands or fingers—i.e. the whole body can be used to interact with the hoop. The hoop is heavy and large enough to be used by adults of all sizes and shapes. Many of the motions that can be imparted to the hoop are done with the limbs, without the hoop spinning around the body. The hoop can be turned or moved in many ways by the hands in front of the body (or to the side or at the back). The ends can be taken apart (FIGS. 3A,3B), and joined with other hoops. In this configuration it can be used like a jump-rope. Large (4 feet and larger) diameter hoops can be spun around the torso of two people who are inside the hoop at the same time. Much of this is possible with an unlighted hoop that is large and heavy enough and taped properly. But the lights give a reflection of the movements of the hoop. Thus with this lighted hoop instrument it is easier to see what effect one is having on the movement of the hoop at any instant. The feedback from the hoop is visual as well as kinesthetic. And with the sound function turned on the feedback is auditory as well.

Figures 27A, 27B, 27C, 27D, 27E, 27F, 27G, 27H, 27J:
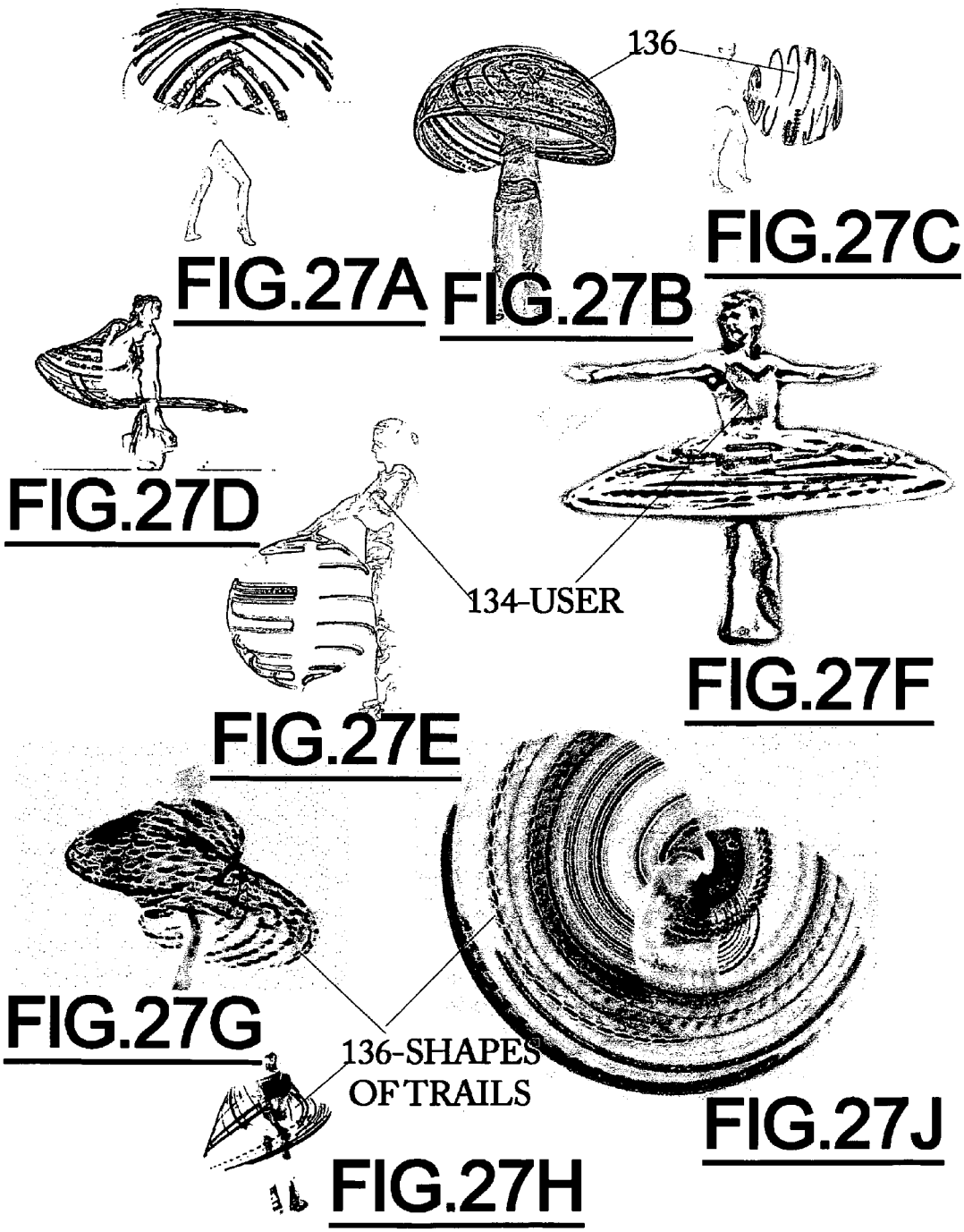

Video of a hoop at night with only one LED lit reveals the pathways that any point on the hoop follows. This is important to know when you are trying to work out how to program, affect or improve the visual display of a hoop, or interpret the data that a sensor is accumulating as to its motion. A spiral path is shown in FIG. 20A. The axis in this case is the wrist, with the hand being held above the head and the video camera looking down from 20 feet straight above the "hoopster". (FIGS. 27A and 27B show 2 hoopsters spinning hoops above their heads in different patterns). You will notice that the light takes 8 or so revolutions to reach its outermost point on the spiral, and then (FIG. 20B) (The path is shown flipped vertically for ease of illustration) it describes a similar spiral on its way back to the axis, in this case the wrist of the performer. This is compared to (FIG. 20C) where the hoop is turning around a wider diameter axis 126A, in this case the waist. Here we see 128 the light only takes two revolutions to reach its outermost point, and then spirals back in two more revolutions. This motion of each point in the hoop is what makes the trails and patterns of lights produced by this invention. It is from these kinds of movement paths that the sensors (Micro-Electro Mechanical Systems—MEMS, or accelerometers or other electronic or electromechanical sensors) output their signals to the LEDs, EL wire, receiver, computer, audio equipment or other hoops and displays.

Figure 24A:
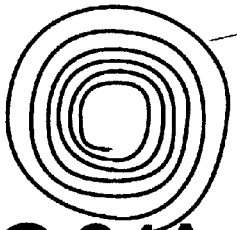
Figure 24B:
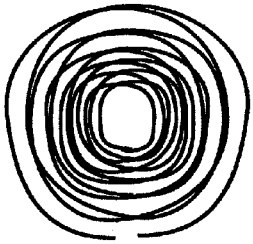
Figure 24C:
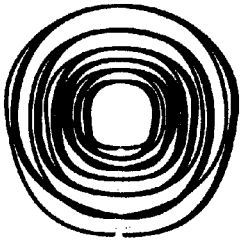
Figure 24F:
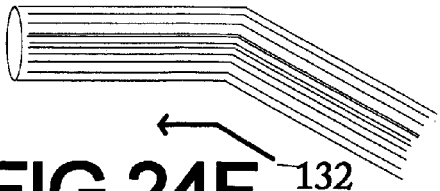
Figure 24D:
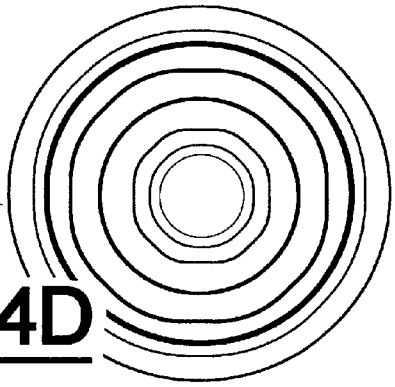
Figure 24E:
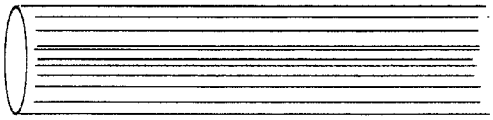

This spiral (FIGS. 20A-D) forms the basis of the patterns made when a lighted hoop is spun in one plane, either vertically or horizontally or a combination of those. This is seen if the hoop is used in the manner of a "hula-hoop" with different parts of the body forming the axis, or when the hoop is spun around the arm, hand or wrist, outside the body. This spiral is further illustrated in FIG. 19B. The axis 126A in this case is the waist or chest of the hoopster. The whole hoop 29 is illustrated here, along with the different points on a spiral 128A-D that a fixed light 128 travels through, on its outward path. This might only take a second, if the hoop is being spun fast. As the hoop continues to spin (FIGS. 24A-C), the light spirals in and out and creates the appearance of circles of light (FIG. 24D). With different colored lights in the hoop, patterns appear (FIG. 26C). Furthermore, if the hoop is taped (FIG. 1) complex patterns (FIG. 27J) appear.

Figure 21A:
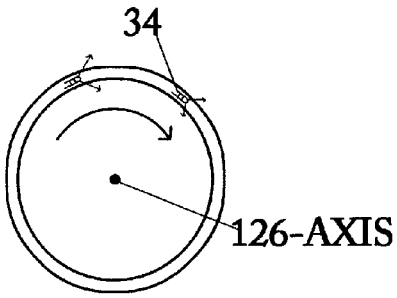
Figure 21B:
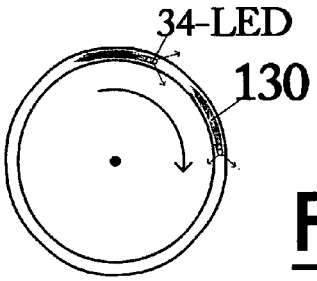
Figure 21C:
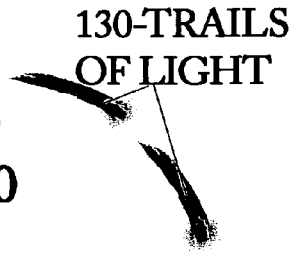
Figure 22A:
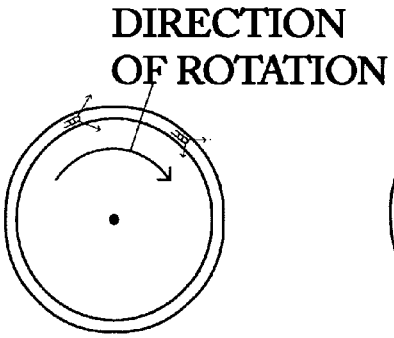
Figure 22B:
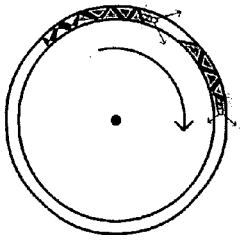
Figure 22C:
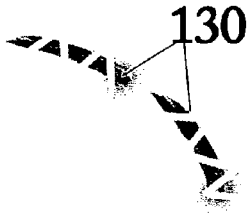
Figure 23A:
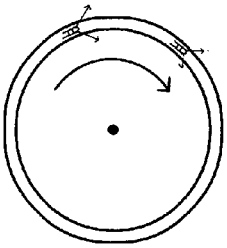
Figure 23B:
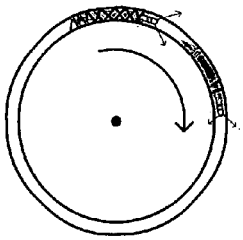
Figure 23C:
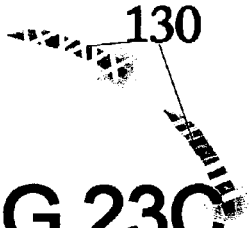
Figure 23D:
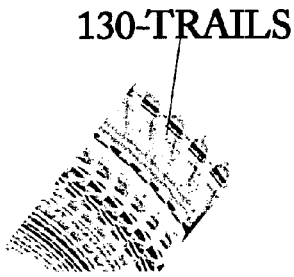

This spiral is not the only pathway of a light source fixed in a hoop. The hoop can be turned around its own axis (FIG. 19A), either in the air, or using the hands outside the body, or spinning the hoop on the ground. This causes the lights 34 to move in the direction of rotation 128 and to leave trails (FIGS. 21A-C). The length of the trail is proportional to the speed of rotation. The addition of tape on the surface of the hoop (FIG. 1) creates shapes and patterns of lights (FIGS. 22A-C, FIGS. 23A-C). The trails 130 (FIGS. 23C and 23D) become complex and varied. With the addition of different colors the trails become more interesting. One color mixes with the next one to produce intermediary colors. 3 color LEDs now come with their own mixing, flashing and fading patterns, and by selecting these carefully and arranging them in sequences (FIG. 6) 34C, 34D, 34E a multitude of colors and patterns emerge.

By varying the speed and direction of rotation, the acceleration and deceleration of the movement, patterns of light and color can be created even without the use of mechanical, electromechanical, or electronic sensors and switches. The addition of these sensors and switches (FIG. 6) 38B, (FIGS. 9, FIGS. 10, FIGS. 11) adds more control, interactivity, and deepens the experience of synergy between the lights and the movements. The kinesthetic and visual senses are coherent, and this adds depth to the performance, and sensitivity to the feedback the performer gets from the hoop.

Figure 25A:
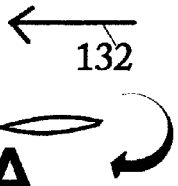
Figure 25B:
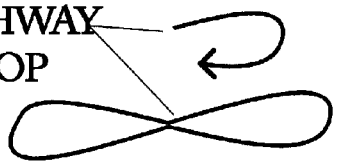
Figure 25C:
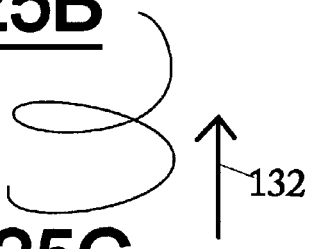

The hoop can be moved through space in many ways, and this adds variety to the colors and trails produced. The hoop can make a ball (FIGS. 26A and 26B) by being spun on the hand in the air (FIGS. 27E, 27C), or on the ground. The hoop can be moved straight through space (FIG. 24E) and leave the outline of a cylinder. Geometric shapes can be created (out of light and color) by changing the direction of movement (FIG. 24F). The trails show the pathway 132 of the hoop. FIGS. 25A-C show other pathways 132 that the hoop can make in the air or around the body. These, and other pathways, combined with the spinning of the hoop itself, provide an infinite variety of display. Some of these displays are shown in FIGS. 27A-H, and FIG. 27J.

Take the simple case of spinning the hoop around the arm in a vertical plane (FIG. 27J), or in a horizontal plane around the waist (FIG. 19B). Any one point on the hoop is going to vary its speed from stationary (for an instant as it goes into the body and bounces off) to its top speed (as it reaches its outermost point on the spiral). Different points within the hoop are going at different speeds relative to the axis of the movement. This can be illustrated by holding the hoop in one hand and waving the hoop up and down, keeping the hand fairly stationary. The outer part of the hoop obviously travels much faster than the part in the hand. This variation in speed creates different color mixing effects even without the use of any other control of the LED. A similar variation in speed can be observed in fairgrounds when you ride inside a teacup that is spinning as the whole base of the ride is turning. Your speed varies; acceleration occurs.

There can be any number of LEDs in the hoop. Between 1 and 40 is practical in this preferred embodiment of the hoop instrument. Since each LED can actually have three LEDs of different color in it, (FIG. 6) 34C and E, that makes the total of light sources to be between 1 and 120. With a sequencer or driver (FIG. 14), each LED can also be controlled to be on or off at any one moment, to stay lit for a certain interval and to have a certain brightness value. So the lights can appear to spin around the hoop when the hoop is stationary, or to appear stationary when the hoop is spinning and so forth. The individual colors on the 3 color LEDs can also be controlled so that the intermediary colors appear, either flashing or fading. With an electronic sensor more control is possible. The LED can be made to vary its output based on its position or speed or acceleration along any of the three axes. Thus in the case above of spinning the hoop on one axis (FIGS. 27J, 19B), as the sensor and then the LEDs move through the different points on the spiral pathway, the LEDs could change from red to green to blue based on their speed, and so a flower shape (mandala) will be produced from the trails (FIGS. 26C, 27J).

In the preferred embodiment of this interactive hoop instrument, the hoop has to be made well enough so that it performs smoothly at any speed. It must enhance the creativity, skills and display of the performer. It must not break or malfunction. It must be bright enough for thousands of people to see in a stadium or on a stage. It must have sufficient variety in display to be interesting over a period of time. It has to have sufficient control and sensitivity of its feedback systems to be truly interactive and expressive as an instrument. It has to have a range of physical and performance characteristics, so that bodies of different sizes and shapes, and users of different abilities can all enjoy it and make it perform well. This is similar in the field of sports to the different shapes, lengths, and flexibilities of skis. Thus my preferred embodiment of this interactive hoop instrument includes a range of properties, not limited to one specific size or weight or control system. In the previous year I have made over a hundred lighted hoops for performers and dancers and people who want them for exercise or entertainment or development. Each of these hoops has been crafted individually and except for 2 of them that were specifically ordered identical (for a Hollywood film), they were all different.

The tubing for the hoop instrument is selected for its physical properties as well as its translucency. The hoop can be made from polyethylene, but the LDPE (low density polyethylene) creates a sluggish movement at times, and the HDPE makes things bounce a bit too much and is hard on the body. The polyethylene has a certain opaque quality that makes the tubing light up in an interesting way, without the small focus of light that a clear tube produces. The LDPE tubing is ideal for smaller hoops of 33 cm (13 inches) to 56 cm (22 inches) which are used specifically to spin around the arms, hands or legs, or as juggling hoops. The LDPE tubing is also good for smaller children's hoops of 76 cm (30 inch) to 91 cm (36 inch) diameter where flexibility of the tubing is a bonus in terms of prevention of injury from constant rotation on the body or impact with a spinning hoop. Small hoops from, 0.559 meters (22 inches) to 0.99 meters (39 inches) in diameter are also well made from smaller diameter polypropylene tubing). The outside diameter (OD) of the tubing is 1.905 cm (¾ inch). The wall thickness 31 (FIG. 30) is best at around 0.15875 cm (1/16 inch).

The preferred embodiment of this hoop instrument is made from polypropylene tubing. These mid-sized hoops (FIG. 1C) are made with diameters ranging from 0.9144 meters (36 inches) to 1.1176 meters (44 inches). These work best (FIG. 1D) with wall thickness of around 0.238 cm (0.09375 inches). The OD of the tubing is 2.54 cm (1 inch). This material and wall thickness gives a hoop that is light enough to be responsive and of sufficient weight to have the needed momentum to follow certain pathways—required in the performance of certain tricks and manoeuvers.

The polypropylene tubing is more translucent than the polyethylene material. In order to take advantage of that, the lights are wrapped (FIG. 18C) in iridescent or clear tape 120 (FIG. 18B), which is then crinkled up 120A (FIG. 18). This generates diffraction of the light rays 122, and adds depth to the light n the tubing, making it appear like a crystal instead of an empty tube. The diffraction of light from this crinkled tape also adds to the intensity and quality of the light emitted from the hoop.

If more stiffness is desired, a wall thickness of 0.3175 cm (⅛ inch) is used (FIG. 1E). This diameter hoop, 0.9144 meters (36 inches) to 1.1176 meters (44 inches), can also be made with a tubing OD of 3.175 cm (1.25 inches), and the same wall thickness. This gives more surface area and so more traction, and a different feel to the hoop, more suitable to a larger or thicker frame body. The hoop is heavier and responds differently. The thicker wall gives it some extra strength and durability under extreme conditions.

Figure 2:
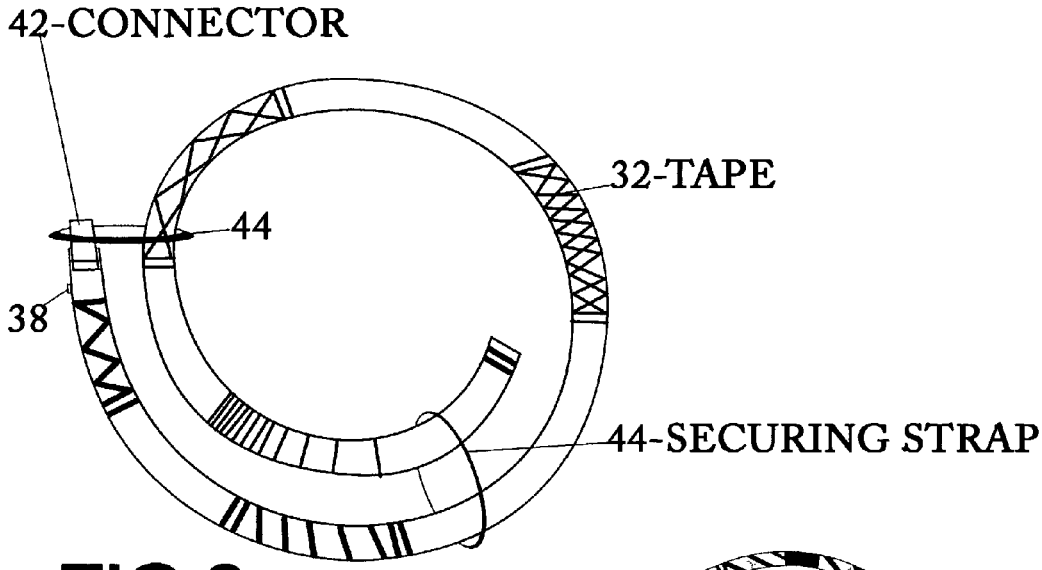
FIG. 2 shows a plan view of a hoop taken apart for travel.
Figure 16D:
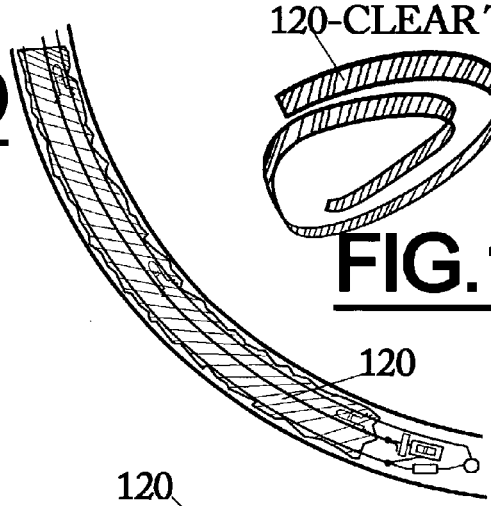
Figure 16E:
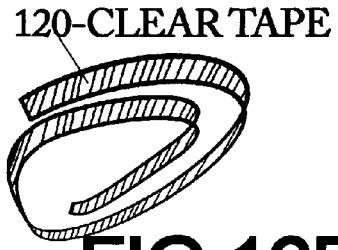
Figure 16C:
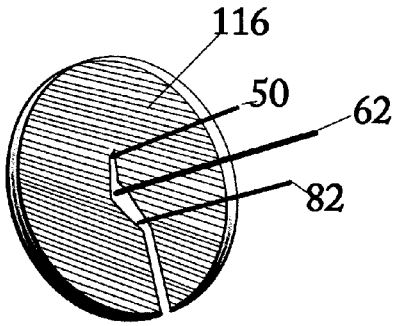
Figure 16F:
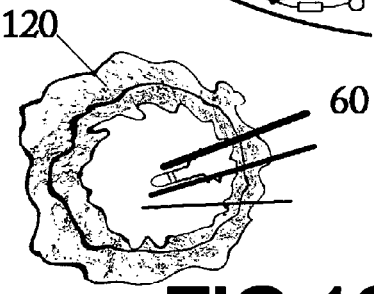
Figure 16B:
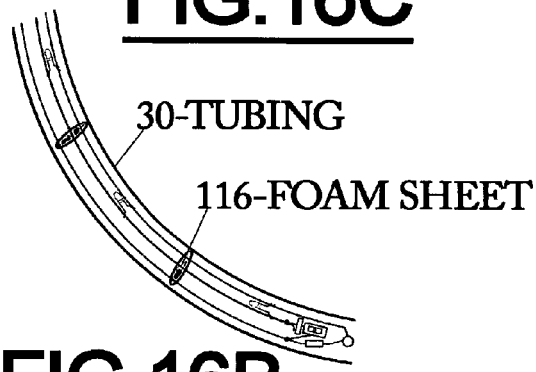
Figure 16G:
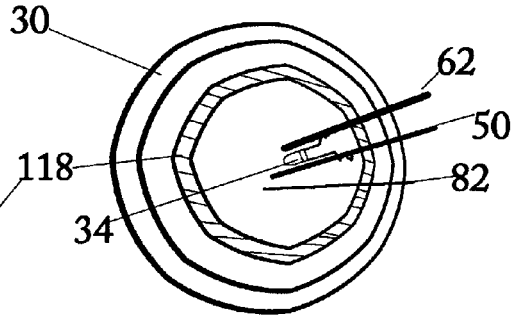
Figure 16H:
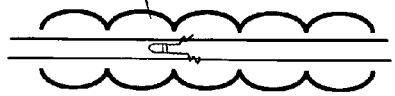

The wires and LEDs inside the hoop rattle around, make a noise, and weaken the internal connections unless they are held in some way. In the preferred embodiment of this instrument, the clear tape also functions as a sound reduction system (FIGS. 16E and 16F). The tape holds all the components snuggly inside the tube and there is little or no movement of the wires, circuit boards or LEDs. In order to further stabilize the internal parts of the hoop, (FIG. 6A) the batteries 60A are taped 166 around the supporting wire 62, and then after the whole assembly is threaded through the hoop tubing, holes 124A are drilled in the tubing, at the place where the battery is located, and then hot glue 170 is injected into the tubing around the battery to hold it in place, despite the violent movements and impacts the hoop is subjected to. (The hoop can be bounced off the floor or strike other hoops, or change direction suddenly or be subjected to sudden vector changes). The soldered 172 joins of the LEDs to the wire, or of the circuit boards or switches or sensors, are also glued 170 after soldering, to increase their stability and life. Both ends of the supporting wire 62 (FIG. 8A) are threaded through holes 174 drilled in the tubing. This further stabilizes the internal components. The connector 42 is tooled on a lathe to fit exactly on the female end 48 of the tubing, so that the hoop can be taken apart and put together easily but still have snug support without wobbling. The hoop is taken apart for transport on a plane or to mail the hoop (FIG. 2). Here it is shown held together with a securing strap 44. Gaffers or vinyl tape could also be used to secure the ends of the hoop. When the hoop is in use, a wrapping of strong clear strapping tape 178 or cloth tape 32 is wound around the connection to secure it. The hoop can be used without tape if it is spun and worked gently. This would be the case when the ends are then taken apart during use of the instrument (FIG. 3A, FIG. 3B) so that the tubing can be used more as a skipping rope, or connected to other similar hoops to make shapes that are then moved. For extreme play, to lock the ends together, a screw 74 can be fastened through the tubing and connector. The battery 60A or weight 84 in the connector is held in place with glue. The side of the connector forming the male end of the tubing is tooled so it is thicker and the tubing needs to be heated in order to insert it. As the tubing cools it holds the connector firmly in place. A brass pin 72 is used in the extreme model of this embodiment of the hoop instrument, to lock that side of the connector in place.

Figure 8A:
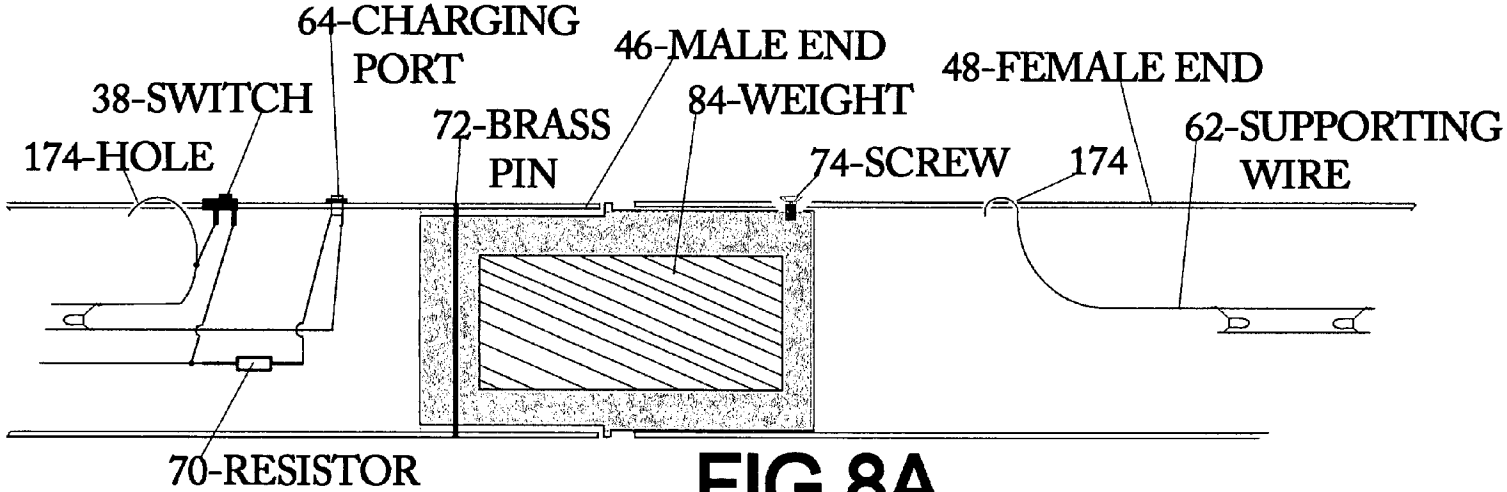
FIGS. 8A and 8B show side views of connectors for the hoop.
Figure 8B:
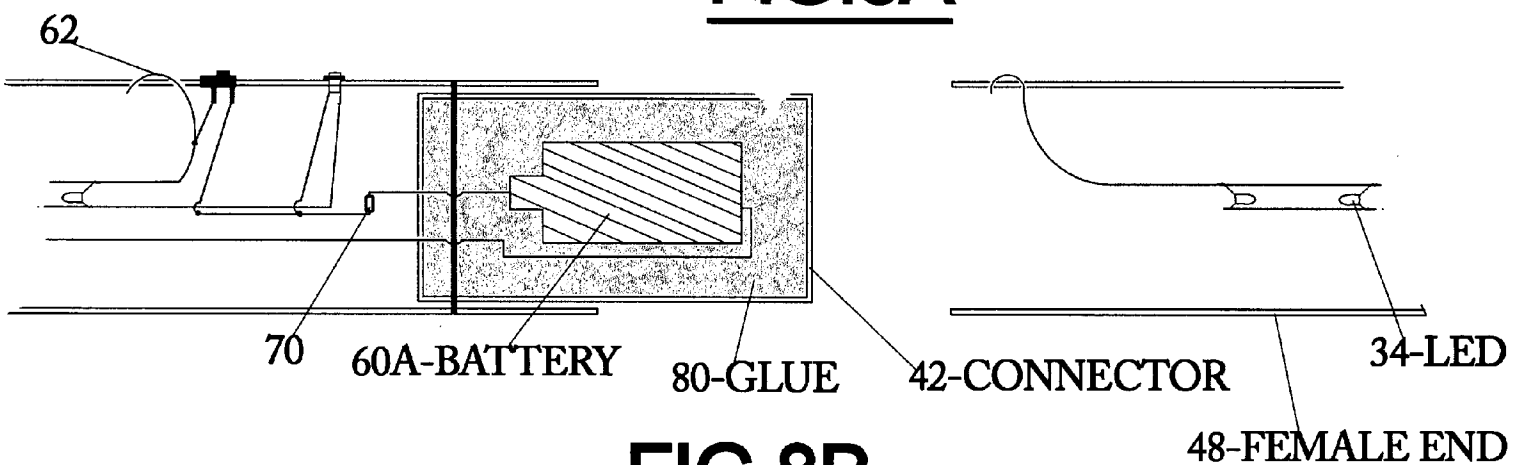

The preferred embodiment of the hoop has a charging port 64 (FIG. 8A). The battery circuit is connected to this with a resistor 70 that is of appropriate Ohms to allow the charger to trickle charge the batteries safely. In the preferred embodiment NiH rechargeable batteries are used because they are more environmentally sound and don't have a 'memory' effect, so they can be charged even if not fully discharged. The batteries 60A (FIG. 6) are placed equidistantly around the hoop so that the balance of the hoop is maintained. Three 1.5 Volt batteries are normally used, and a counter weight 84 (FIG. 8A) is inserted in the connector 42 to provide even distribution of weight. If a lighter hoop is required, then the third battery can be placed in the connector (FIG. 8B). If more power is needed, to provide stronger illumination, a fourth battery can go in the connector to replace the weight in FIG. 8A. The idea is to keep the hoop spinning as evenly as possible.

Taping the Hoop Instrument.

It might seem counter-intuitive to tape a lighted hoop, but in practice taping opens up many possibilities for varying the display of trails and colors and shades. The primary function of tape on a hoop is for traction. The inside edge 180 (FIG. 1) of the hoop instrument is sandpapered for this purpose. Cloth tape gives good traction, due to its thickness and rough texture. It is, however, opaque to a large extent and is thus used with care and proper positioning. The hoop is first constructed and assembled. The batteries are then charged. Then, with the lights on, the taping can be accomplished easily, working over the lights with thin strips of opaque tape, or thicker strips of translucent tape, and forming shapes with the tape that will modify the trails in interesting or predictable ways. The secondary function of the tape is for aesthetic appeal, and with this kind of lighted hoop instrument the aesthetics come not just from the looks of the tape but the effects it has on the lights and trails. Many of the patterns produced by this instrument are directly created or modified by the taping on the outside of the hoop. Tape of all widths and degrees of translucency is used. A tape cutter produces the thin strips. If a lot of metallic or laser or holographic tape is used that makes the hoop too slippery, then it can all be covered by rough surfaced but transparent tape, such as strapping tape. The tape also adds weight to the hoop, so in general not too much is used unless the hoop needs extra weight. In general, the thicker the tape and the greater the distance between strips of tape on the surface of the hoop, the longer the trails produced. Thin strips of tape, down to about 0.2 cm produce more intricate variations in the trails. The tape can be adjusted by the user, depending on their preferences, being easily removable. If the hoop is to be used frequently in the daytime or under bright lights, where the visual display is minimized, taping the hoop with laser or holographic or metallic tape can give some more visual interest. Because these kinds of tape are slippery, thin strips of cloth tape can be placed over them at intervals. The whole hoop, or certain parts of it, can then be wrapped in transparent tape that has better friction. If the hoop is to be used under UV lights, then black light sensitive cloth tape gives it color and appeal.

The preferred embodiment of this interactive hoop instrument has one or more electronic sensors 100 (FIG. 11B) on board. This embodiment uses a type of sensor known as an accelerometer. The accelerometer measures vector changes along 3 axes and outputs a signal depending on the movement of the hoop. When the switch 64 is on, and the hoop is picked up or moved, the sensor detects the movement and activates the LEDs. To increase the speed of response of the instrument, more than one sensor can be used. In this case they are distributed evenly around the hoop. Each sensor can communicate with its own set of LEDs or sections of EL wire, and also send signals to the processor nearest the switch and radio transmitter/receiver. This option increases the cost of production, but also increases the sensitivity and responsiveness of the synthesizer hoopother.

This signal coming from the sensor controls the individual colors of the LEDs, in ways that depend on the program selected. The program selected can be through buttons 108 (FIG. 14), or in this preferred embodiment, the program is selected by quickly reversing the direction of movement of the hoop, along the x-axis 182 (FIG. 12B). Other movements could be used to signal a change in program. However, the hoop performs so many different movements in the course of its use, including bouncing and bumping and being thrown in the air, that one of the more useful signals is a sudden change in direction along this axis of the sensor. The LEDs can be controlled as to their on/off state, their color, intensity of illumination, duration of illumination, and mixing with other colors. These factors can be independently controlled by the movements along the three axes of the sensors. In practice this results in an infinitely variable display. Some of the displays are geared toward performance, some favor different styles and rhythms of dance and movement, some are specifically intended to hone skills and improve awareness of the capabilities of the hoop instrument.

The preferred embodiment of the interactive hoop has sound capabilities. (FIG. 28A). The electronic sensor, (or up to 3 sensors) 100 outputs a signal depending on the movement of the hoop. This signal is sent by a radio transmitter 140 to a wireless receiver 142. The signal goes through a cable 146 to a computer 148. The computer interprets the data and sends an output signal through an amplifier to loudspeakers 152. The way the computer interprets the data is by means of a synthesizer or similar program.

For the sound capability of the interactive hoop, the simplest embodiment uses existing music files in MP3 or .WAV format. The computer modulates qualities and sequence order of those files based on the input signal from the sensor in the hoop. The volume is modulated depending on the rhythm of the hoop. Panning between speakers is varied based on tilt (Y-AXIS) 182A (FIG. 12B). Tempo is adjusted, and pitch compensated, with the revolutions per minute of the hoop. When the hoop is moved very slowly, as in rotating it vertically in front of the body on its own axis (FIG. 19A) slow music is selected and variations occur within set limits.

The performance version of the hoop extends these sound capabilities. The input signal going to the computer is interpolated into midi information or otherwise processed. Distinct sounds and combinations of sounds are produced. These sounds, chords and rhythms are aligned to movements along the X,Y,Z axes (FIG. 12B) of the electronic sensor in the hoop. In the case of many hoops, each hoop can be assigned an address and a certain program of sound synthesis, and so each hoop can generate one type of instrument, or all the hoops can play percussion and accompany live drumming, and so forth.

The sound capabilities of this lighted interactive hoop allow it to give feedback even under bright lights. The visual display will be dim or unseen, but the sensors will still send their signals to be processed as described above.

"Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved."

Advantages—Preferred Embodiment

The synchronization of body movements with the colors, trails and patterns of the lights, allows a whole new form of expression and experience. With the addition of sounds generated from the same signals, a coherence of sound, sight and feeling is produced. This increases the interest in viewing the performance. It allows for very detailed and obvious feedback to the user about their quality of movement. It rewards increased skill with more range and control over the audio and visual displays. The hoop becomes interactive in that every movement made by the user is associated with audio and visual perceptions. These perceptions affect the quality and range of the user's movements, which in turn result in more coherent, pleasing, informative or interesting displays and sounds. The synergistic action of the sounds and visual imagery produced deepens the kinesthetic sensation. The hoop becomes an instrument. An instrument that combines the characteristics of a ball, video game, and piece of exercise equipment, with a musical instrument and a light show all in one!

The instrument is designed so that it gives results and satisfaction at any skill level. Anyone can get some sort of light display and make sounds. In order to control the lights and sounds, and make more interesting displays and connections between sounds, lights and movements, the user needs to become more proficient in the skills of using a hoop. Certain displays and sounds require certain moves and these become easier, smoother and faster as the user's skill level improves. Music can be generated or controlled effectively as the user becomes more skilled. There is thus a natural encouragement to advance through practice and play. It is not all a matter of tricks to learn. There is a certain feel and quality of movement which transfers through the hoop instrument and is developed over time. Flexibility, endurance, strength, speed, proprioceptive awareness, coordination—these are all encouraged naturally through the use of the hoop instrument. In group situations, for some coherent sound to emerge, and for the individual hoops to synchronize or harmonize with each other, there has to be a degree of communication and involvement similar to that experienced when improvising with drums or other musical instruments. As using the hoop instrument is not a sedentary activity, and the whole body is being used, this may have an affect on the fitness and well being of the individual.

Description and Operation of Alternative Embodiments

Figure 6:
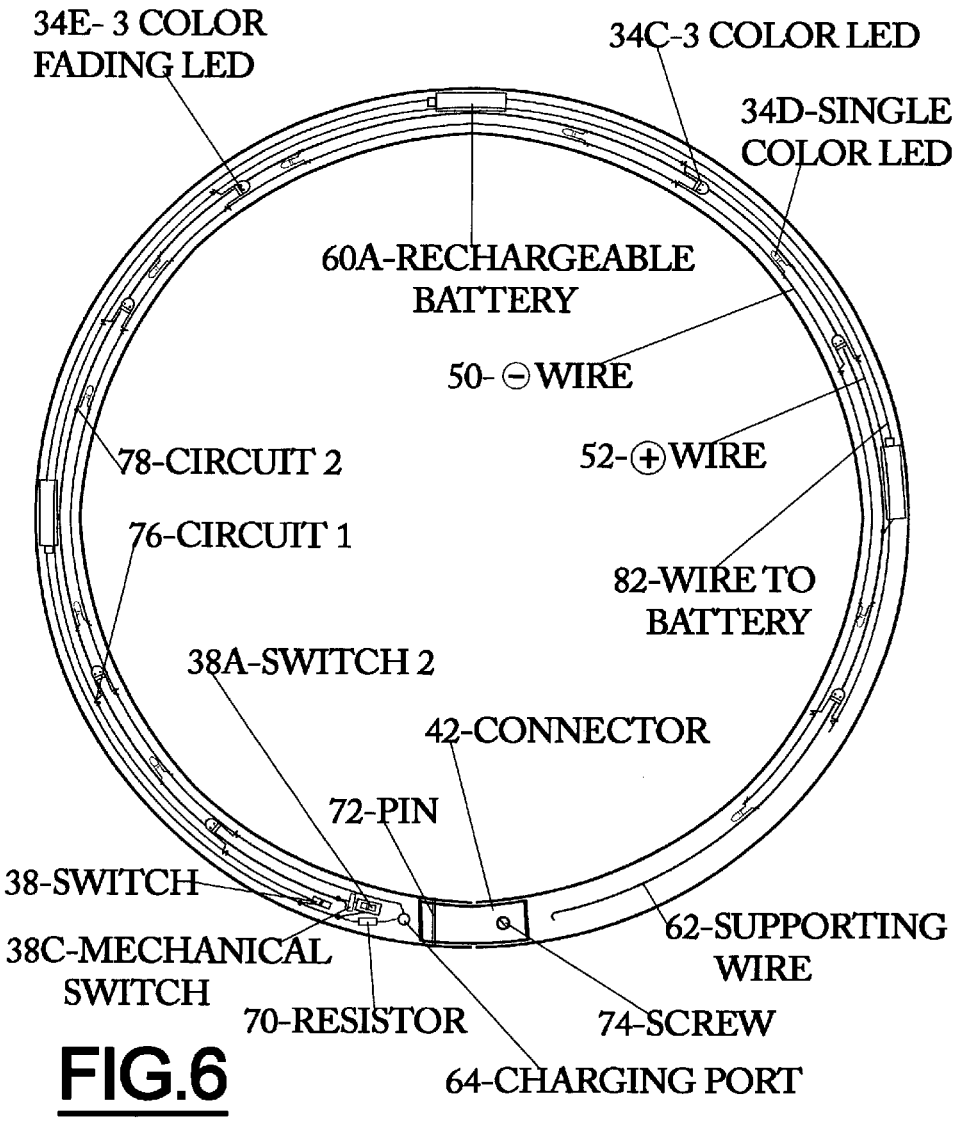
FIG. 6 shows a plan view of the insides of a hoop.
Figure 6A:
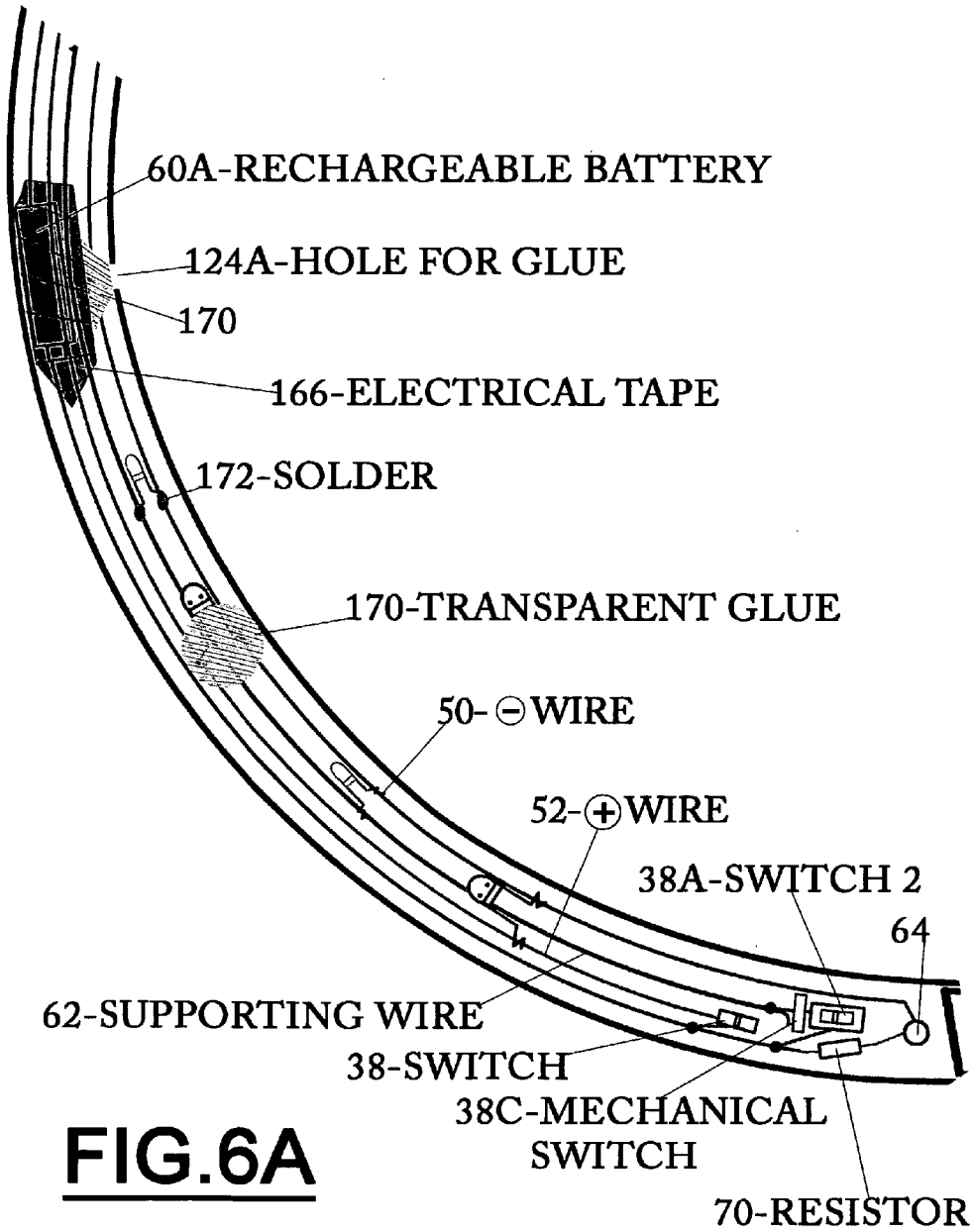

An alternative embodiment is shown in FIG. 6, where this is a simple hoop with two circuits 76, 78. There are two switches 38,38A, to allow for different effects in the lighting to be created manually. The hoop has a mechanical or electromechanical switch as shown in FIGS. 9A, 9B, 10A, 10B, 10C. The switch in FIG. 9A consists of a ball-bearing 86 rolling back and forth inside a copper tube 90. There are two sections of copper tube with a gap between them. When the ball bearing rolls across this gap it makes electrical it completes the circuit. The copper tubes are held in place by being inserted in a plastic tube which holds them tightly. At one end of each copper tube there is a bend 90A to keep the ball bearing inside. The whole arrangement can be placed at different angles to the hoop tubing to vary the way in which the ball rolls.

Figure 4:
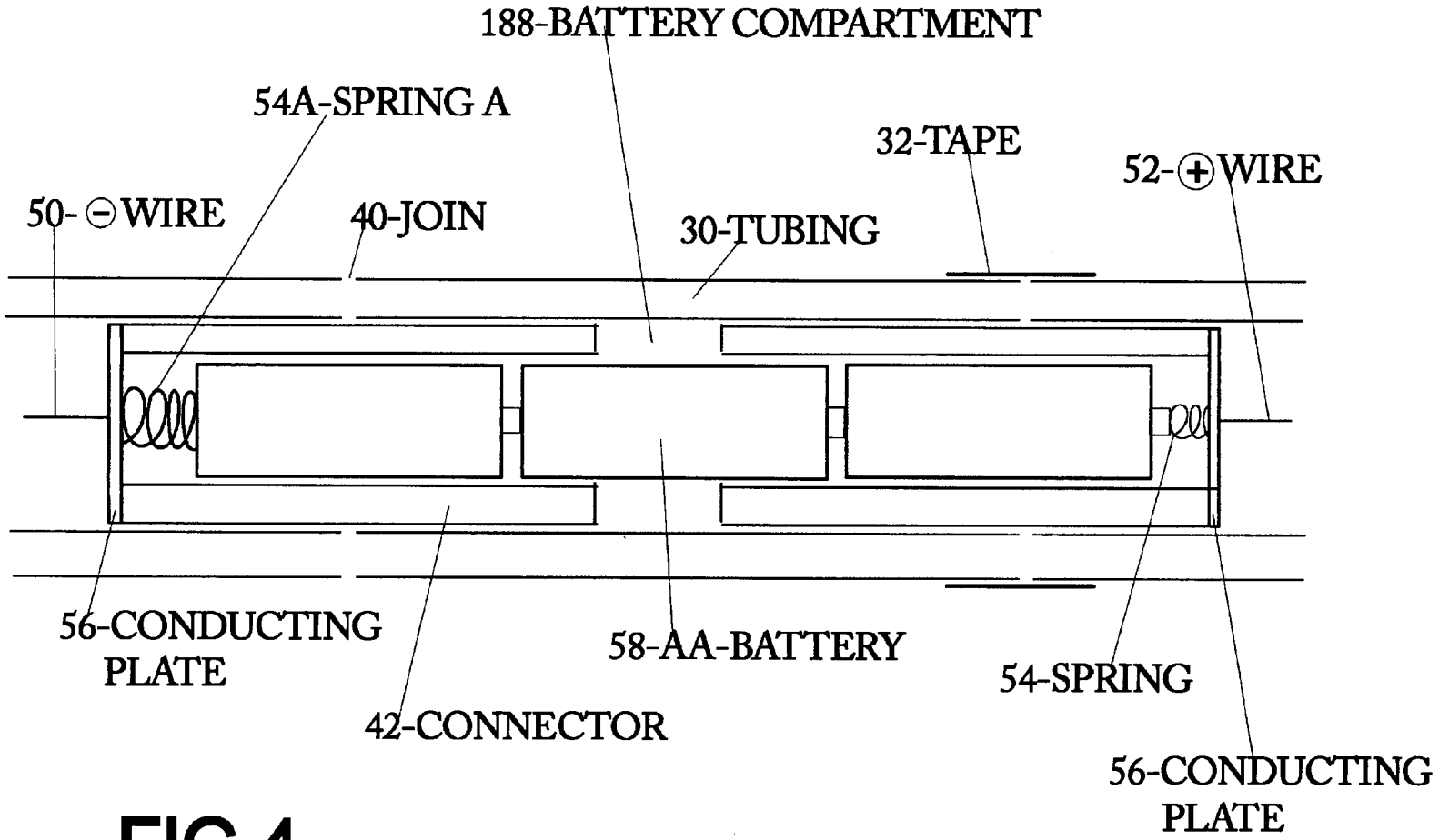
FIG. 4 shows a side view of a battery compartment
Figure 9B:
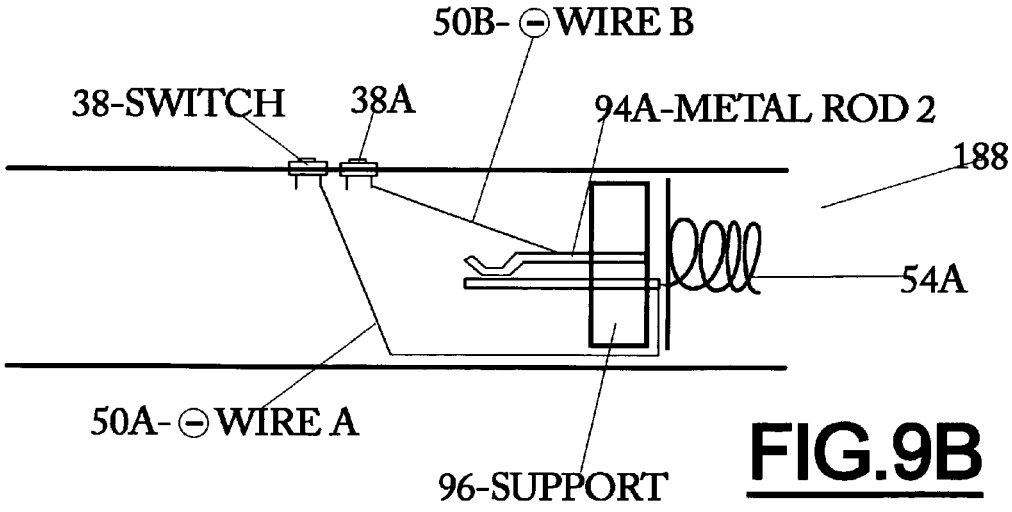

FIG. 9B shows a switch made from two pieces of metal rod 94 and 94A. They are both held by a support, which is attached to the conducting plate 56 at the end of the battery compartment (FIG. 4). The metal rod 94A is bent and touches the metal rod 94. When the hoop moves in certain ways the connection is broken and this sets off a sequence with the lights.

The battery compartment (FIG. 4) is used when rechargeable batteries are not optimum. An example of this is when the hoop is going to be used in places that have no electricity for a charger. Ordinary AA batteries 58 are inserted into either end of the compartment, and then the compartment is slid shut. The join 40 is then taped. A spring 54, at either end of the compartment, keeps the batteries in contact during use of the hoop. The compartment is designed to be just the right size so that electrical connection is not lost during extreme activity with the hoop. This configuration requires two joins in the hoop 40 and 40A. 40A is secured with glue and then taped permanently. This arrangement is ideal for camping trips and continued use outdoors and on the beach. There are less electrical components, no electronic sensors, and the batteries don't have to be recharged. In a normal hoop configuration like this with 20 LEDs, 3 AA batteries can last for 16 hours. The disadvantage of this configuration is that the weight is not balanced and the hoop wobbles slightly when spun in the air. The addition of extra weights in the tubing to balance the hoop is usually counterproductive because of the excess weight. AAA regular batteries with counterweights are a viable alternative, depending on the size of the hoop and tubing.

Also used in this alternative embodiment of the hoop is a switch with slightly more complex behavior. FIGS. 10A,B,C. The ball bearing 86 is surrounded by a plurality of copper rods 98. These are bent over and held in place by two layers of tubing 92A,92B. As the hoop performs its moves, the ball bearing makes and breaks contact between the copper rods and the lights start and stop their sequences.

This alternative embodiment has no sound component, no electronic sensor, no rechargeable batteries or charger, and so is simpler and cheaper to manufacture. The careful use of tape, and the right placement of different types of LEDs, still allows for the possibility of much interactivity and creativity on the part of the user. Light colors, patterns and trails all vary with the type and quality of movements made by the user. The synergy between the trail patterns and the movements of the performer is still exciting, even with this simple embodiment. To some it has a more "organic" feel and so, with either rechargeable or regular batteries, is a viable alternative.

An additional embodiment is illustrated in FIG. 14 where a driver 110 controls the sequences of the LEDs or animates the EL wire 112 (FIG. 15A) The driver is attached to a 3-button switch 108, each button controlling one of the colors of red, green or blue on the LEDs 34B. Preprogrammed sequences can be accessed through a combination of button pushes. Hundreds of programs are accessible through a combination of these 3 buttons, especially since holding down any of these buttons for more than an instant causes a change in the timing of the sequences. The illustration shows individual wires 110A going to the 4 terminal 3 color LEDs 34B. These wires could also be replaced by a chip that communicates from the circuit board 104 (FIG. 11B) to all the LEDs. The 3-button switch is another way to change programs for the light or sound functions of the hoop. It does require some dexterity in finding the right buttons to push, and may thus interrupt a performance, if it is relied on as the sole means to change a program (for the lights or sounds). The 3-button switch is valuable if it is used in conjunction with another kind of signal to the sensor. The buttons can be used prior to the performance or workout or session, to set up the basic program. A quick change in direction of the hoop, or other such signal, can then signal the sensor to change sequences within that basic program.

Another additional embodiment is shown where EL (Electro-luminescent) wire 112 (FIG. 15B) is used in place of LEDs. This gives a different look to the lighted hoop. The El wire is wrapped around a clear central tube 30A inside the hoop tubing 30. Different colors can be used and in different combinations. FIG. 15C shows El wire in three strands of different colors A,B,C, arranged longitudinally and in a spiral. The EL wire can be wrapped directly in the clear tape or sheathed in a thin tubing 30C. Three 3V Lithium batteries are used in this embodiment.

Figure 7:
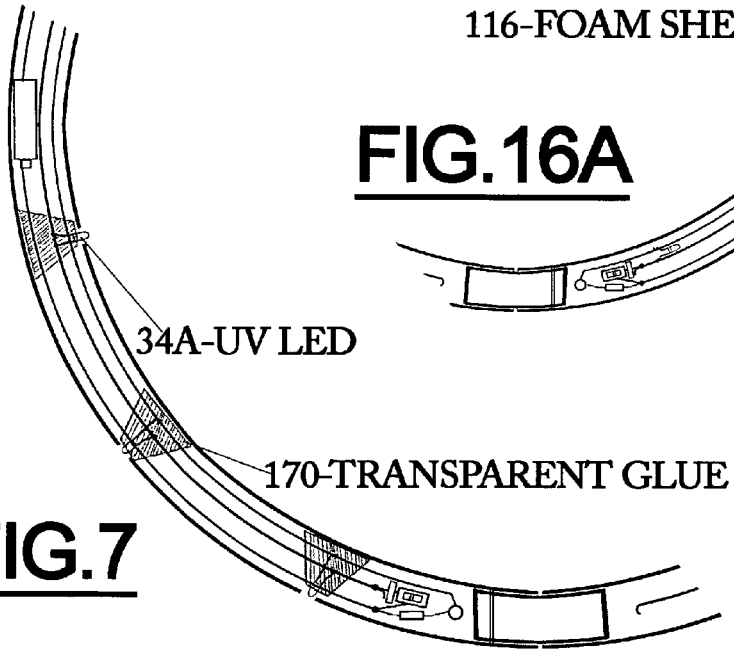
FIG. 7 shows a plan view of a section of a UV LED hoop.

Another additional embodiment involves the use of UV LEDs 34A (FIG. 7). The UV LEDs are used in place of the color LEDs. Holes need to be drilled in the tubing at the points where the UV LEDs are pointing, so that the plastic material does not absorb too much of the UV light. The UV LEDs are then held in place with injected foam or glue 80. The idea here is for the performer to wear black light sensitive clothing. Fluorescent paint or tape can be put directly on bodies or clothes. As the hoop is spun, the lights swing in and out from the body, illuminating different parts with each revolution and creating an interesting effect. This embodiment is really only intended for performers who put on black light show in the dark. The lights are not strong enough to create much effect if there is a lot of ambient light. In the darkness, however, the effect is startling.

Another additional embodiment of the lighted hoop (FIG. 17A) is to have hundreds or thousands of holes drilled all around the tubing, which in this case would be black or opaque, and not taped. The edges of the holes provide enough traction. The light rays are seen emitting through all these holes, and create another interesting variation. A sheath or covering with holes or different patterns could be created from material or wider diameter plastic tubing to put over the preferred embodiment of this hoop instrument. This would give it different looks and displays, which could be put on and taken off easily.

M additional embodiment of this interactive hoop is illustrated in FIGS. 16A,B,C,D,E,F,G,H AND 17B,C,D,E,F. White pieces of foam sheet are cut and glued at regular intervals around the wires inside the hoop. This acts as a noise reduction system, preventing the wires and LEDs from clattering around against each other and the wall of the tubing. The foam pieces also act to reflect light out of the tube, and look like additional LEDs. A flexible ridged thin and slightly opaque plastic tube 118 (FIG. H) can also be used to contain the wires and LEDs and to change the appearance of the inside of the tube and of the light emitted. A clear tube is desirable from the point of view of the brightness of the light. Completely transparent tubing 30D (FIG. 17E) is not always ideal, however, as it does not scatter the light, and changes the display into more of a 'digital' one than the 'analog' feel you get when sections of tube glow with color. The slightly opaque tubing 30B also allows for greater color mixing. It also hides the wires and bits and pieces inside the hoop. The flexible tubing 118 serves to provide some opaque container for the lights and mix the colors.

Another type of sensor is shown in FIG. 13. It is to be noted that many kinds of sensors can be used to increase the interactivity, feedback and control of the lights and sounds that can be made with this hoop instrument. The pressure sensors 106 and 106A are set into the inside wall of the hoop, where they come into contact with the body parts of the user. They can also be pressed with the hands. The changes in pressure caused by angular momentum, variations in softness of different body parts, or direct manual squeezing of the hoop, causes different signals to be sent to the LEDs directly, in terms of voltage, or to a circuit board which then "talks" to the LEDs. This type of sensor also acts as a mechanism to change programs while the hoop is in use. The sensors stick out slightly from the inside surface of the hoop tubing, so they are easy to find. The pressure sensors 106, 106A can also be placed on the top surface of the hoop so that they don't interfere with the hoop's movement on the surface of the body. In this case the sensors act only from pressure or touch from the hands, and are used solely to control the sequencers or programs on the board.

An additional embodiment of the hoop is shown in FIG. 28B. The radio transmitter 140 is held in place by a metal pin 186. The wireless receiver 156, is also a wireless transmitter and sends signals to wireless headphones 158 that can be worn by the user of the hoop. The user can thus groove to their own music without disturbing the neighbors or anyone else, especially as it may take a while before the user establishes fluent control over the sounds produced.

In a further embodiment of the interactive hoop (FIG. 28C) there is a radio receiver/transmitter 162 in the hoop. This allows for networking between different hoops and the computer 148. The signals flow back and forth from hoop to hoop and from hoop to the computer. From the computer 148, wireless 142 or wired connections are made to other display modules 164. The hoop now has the capability of generating a visual display outside of itself. For instance, an ice rink could be equipped with thousands of LEDs embedded in the ice, and the hoop can be used as an instrument by the skater and cause the ice to light up in similar patterns to those that appear in the hoop. Or the walls of a venue can have LCD screens which display the patterns created by the hoop instrument synchronously with the sounds produced by one or more of these instruments. Music concerts could do a similar thing.

When the hoop is not being used as a performance tool it can function as a light show by having its lights flash in time to the music. The music in this case would not be being produced by the hoop. Thus this is not a primary or even recommended use of this instrument. The whole idea of this hoop is to create an interaction of the visual, kinesthetic and auditory senses. This is achieved by the performer or user of the hoop generating the visual and auditory effects through the movement of his or her body, in an interactive fashion. Music created by another source, either from a live musician or recorded music or another hoop performer, could be routed through the computer and the wireless transmitter and received by the hoop, generating a pulsing of the lights in a particular color. The user of the hoop would then adjust other colors through his or her rhythm and movements, to combine them with the signal coming from another source.

CONCLUSION, RAMIFICATIONS AND SCOPE OF INVENTION

The invention started out as an improvement in the construction, use and quality of a lighted hula-hoop. My idea was to have it become an instrument (in the style of a musical instrument and light synthesizer) that could be played with the whole body. This was an effort to generate an aspect of synaesthesia, where the senses translate from one to another, as in seeing colors when you hear music. Also where two or more sense inputs combine in the nervous system to produce some new perception, sensation or feeling. Examples of this include a well-produced movie, ballet or dance. Light shows or multimedia experiences also use this principle. The synergy of light and sound, especially when they are closely related to one another in some way, for example in rhythm, produces something new or something more interesting than the separate elements. This phenomenon is what drives TV, movies, shows, audio visual art, advertising and so on.

With the hoop, one has a perfect shape for an instrument to add another sense to the mix—the kinesthetic or proprioceptive sense (the sense of where the body is, and how it is moving or feeling). Even without the added lights or sounds, a person and a hoop can create an interesting display for an audience. For the person using the hoop, the experience can be fun, and can open up an exploration of movement. The hoop in itself has potent symbolism, with a long history of ceremonial, sacred and inspiring use in many cultures. We wear it as jewelry. It is basically a wheel. A curved stick. It produces immediate smiles and interest, perhaps even more so than a ball. You cannot so easily get inside a ball. In that sense the hoop is a slice of a ball—the essential slice for these purposes. It can be continuously moved with little effort. Its movements are pleasing, both to watch and feel. The qualities and range of its movements are endless. So with a well-made, well taped, right sized, aesthetically finished hoop, one already has a winner. The hula-hoop fad of the fifties capitalized on this for children.

When the lights are added there is a further immediate attraction. Turn on a Christmas tree, or provide any spectacular lighting display and some people will get a similar feeling. The hoop has the additional advantage, perhaps, in that the pathways the hoop is following are revealed with more clarity, the shapes of the lights are interesting. When the lights are made bright enough to really see well, and to leave trails of different colors, there is a further increase in the effect created, which can be augmented by having the lights controlled in terms of their pulsing, color mixing, brightness and so forth.

However, a whole new phenomenon occurs when the lights are in some way made to respond to the movements of the hoop. To the audience there is an immediate connection made between the movements of the performer and the display seen. This also works for the user of the hoop. The closer the correlation or coherence between the movement and the display, the better the effect. The first way of working with this is by arranging the lights in aesthetic ways so that they interact with each other as the hoop is moved. Colors mix together, trails are formed that are repeatable and can be seen to arise from certain moves. The taping of the hoop, both inside and out, allows this connection of movement and light to be better seen.

The next step that was made in the direction of achieving a direct coherence between light and movement was in providing mechanical and electro-mechanical switches that turned circuits on and off with the movement of the hoop, or affected the light output in some ways. These were somewhat limited however.

The best result so far in this invention of an interactive hoop instrument was with electronic sensors that can continuously measure the movement vectors of the hoop, and output signals that can be interpreted in various ways. The lights, whether individual LEDs or strips of EL wire, can all be individually controlled as to their on/off state, brightness, duration of flash, and combinations with other adjacent color sources to create a multitude of colors, and so forth. The continuation of this application of technology will result in a more and more responsive, coherent and adjustable instrument. Currently the 3-axis accelerometer works well for this job. It is small enough to fit easily on a small circuit board that can go inside the tubing of even the smallest of these hoops. The price of it has recently become reasonable.

The information streaming from this sensor can be sent via wireless to a receiver which can interpret the information in many ways. One of these ways is to convert it to a midi stream that can be used like any midi information to generate sound waves that have the characteristics of any of the instruments available in electronic music—giving the hoop the possibility of playing a multitude of rhythms and tones. At a simpler level, the information coming from the hoop can be made to modulate the volume, and pan and pitch of selectable prerecorded pieces of music. The effect of having sound that is synchronized with the movement of the hoop is amazing. When you combine the sound and the color together with the movements of the hoop and the performer, you get a whole new level of experience. The exploration of this will take a while. My invention is limited to hoops, but similar systems can be developed with many other shaped instruments, and in many different ways. The essential part is to have the movement originate with the user, preferably as in a hoop with the whole body. Most musical instruments can be played sitting down or with very little movement. The hoop as an instrument, however, requires the use of the whole organism. This not only has ramifications for the world of exercise, entertainment, dance, and so on, but also for personal development in terms of kinesthetic awareness, movement, and expression. The aim of this invention is to provide a new tool for the artist to use. Hopefully it will find its way into schools, gymnasiums, the Olympic rhythmic gymnastics, homes, backyards and so forth. It could also be of use to therapists, occupational therapists, rehab centers, and so forth. Where else can you hear the sound of the feeling of your thighs? Or see, in multi-colors, the degree of tension and feeling in your neck? The hoop instrument can function as a biofeedback device. Choreographers might be interested, as the possibilities for group interaction are certainly there. Each individual with their hoop can be playing a different rhythm instrument or have a different musical voice, and the whole hoop orchestra can also be the dance performers in a simultaneous display. That should be interesting. The synchronization of color and shape I find most interesting when it is generated individually by each instrument and not controlled from an outside source, but that alternative is possible as well. Hopefully the instrument will become refined enough to allow for the expression of many more different feelings, tones, moods and intentions. It could be used in concerts, alone or with similar instruments or in combination with normal musical instruments or other electronic ones.

The hoop shape itself does not need much improvement. A circle is hard to improve on, though one could try multifaceted circular shapes, or polygons. The materials of the hoop tubing could certainly be improved, in terms of transparency, durability, flexibility, traction and so forth, so that the instrument becomes more controllable and responsive and can take even more of a beating. It can be made collapsible so that it can fit into a small bag for transportation, without reducing the integrity of the tubing and assembled hoop or adding to its weight. It could be made to be more flexible for applications such as a skipping rope, or to join it with other hoops to create new shapes. It could be made to be waterproof, and would then be safe on ice, snow, in swimming pools and at the beach and so forth. In its current condition it survives the beach quite well, and has even fallen into a swimming pool in California on one occasion, and a lake in England on another. On both occasions the hoop only spent a few seconds on the water and was resuscitated and is still working. But at the moment it would not like a longer dunking. The source of power can also be improved, as batteries develop. The speed of recharging will be improved, and a charger that runs on all voltages. In the long run I would like to see the hoop be self-powered, because all this circular and spiral movement could easily power a lighted and audio capable hoop. It will take some magnets and coil, but theoretically that is feasible. At the moment the efficiency and size of such an arrangement renders it difficult.

The main advance that I see in current construction is the use of more sensors so that the lag time between movement and display of light or sound is cut to almost zero, thus allowing the instrument to paint a clearer picture of the movement and internal state of the user. Along with that will be the development of more programs to interpret the data coming from the sensors, so that the user can select a wide range of display possibilities, similar to how a synthesizer allows a whole set of outputs from a single input, say a pressure of one finger on a keyboard. The "noise" level will be reduced so that a clearer and cleaner signal continues to emerge. Different sensors will be incorporated to transmit information from pressure, heat of the body in its various parts, skin conductance, and even the internal state of the body as to its magnetic and electric fields. The lights themselves will continue to get brighter and have more variety of color. The speakers could be made to be onboard so that the audio function becomes truly portable without loss of quality. At the moment it is hard to create sufficient clarity, quality and volume to add speakers in the hoop that sound good enough to qualify as beautiful artistic feedback. The design of the hoop as to its color and taping and general look will of course improve.

Accordingly the reader will see that, according to the invention, I have provided an interactive synthesizer hoop instrument.

None of these statements are meant to limit the use or extent of this interactive synthesizer hoop instrument. The above statements are made to illustrate examples of its use and improvement within the scope of the invention. Thus the scope of the invention should be determined by the appended claims and their legal equivalents and not by the examples given.

I claim:

1. An interactive instrument, the instrument comprising:

a hoop configured to fit at least around a user's waist, said hoop comprising;

a power source, a light source;

an electronic control system for the light source;

at least one sensor within the electronic control system; and a radio transmitter located in the hoop and configured to communicate with a wireless receiver, wherein the radio transmitter sends a signal to the wireless receiver which is configured to communicate with an external sound source, wherein the hoop includes a wireless receiver to receive signals from an external source, wherein the external sound source generates sounds that are aligned with movement of a user of the hoop along X, Y and Z axes, wherein the movement is detected by the at least one sensor, and wherein the hoop outputs light based on at least the user's movement.

2. The instrument of claim 1, wherein the signal emitted by the radio transmitter is at least partially based on movement of the hoop.

3. The instrument of claim 1, where in the sound source is configured to emit sound that is at least partially coordinated with the light source of the hoop.

* * * * *